US010697733B1

(12) United States Patent
Lyren

(10) Patent No.: US 10,697,733 B1
(45) Date of Patent: Jun. 30, 2020

(54) WEAPON TARGETING SYSTEM

(71) Applicant: Philip Lyren, Bangkok (TH)

(72) Inventor: Philip Lyren, Bangkok (TH)

( * ) Notice: Subject to any disclaimer, the term of this patent is extended or adjusted under 35 U.S.C. 154(b) by 0 days.

(21) Appl. No.: 16/671,257

(22) Filed: Nov. 1, 2019

Related U.S. Application Data

(63) Continuation of application No. 16/252,726, filed on Jan. 21, 2019, now Pat. No. 10,480,902, which is a continuation of application No. 14/823,528, filed on Aug. 11, 2015, now Pat. No. 10,184,758.

(60) Provisional application No. 62/052,496, filed on Sep. 19, 2014.

(51) Int. Cl.
*F41G 3/08* (2006.01)
*F41G 3/12* (2006.01)
*F41G 3/06* (2006.01)

(52) U.S. Cl.
CPC ..... *F41G 3/08* (2013.01); *F41G 3/06* (2013.01); *F41G 3/12* (2013.01)

(58) Field of Classification Search
CPC ..... F41G 3/08; F41G 3/06; F41G 3/12
USPC ..... 235/400, 404
See application file for complete search history.

(56) References Cited

U.S. PATENT DOCUMENTS

| | | | | |
|---|---|---|---|---|
| 8,678,282 | B1 * | 3/2014 | Black | F41G 3/16 235/13 |
| 2015/0023591 | A1 * | 1/2015 | Potluri | F41G 3/26 382/162 |
| 2016/0084617 | A1 * | 3/2016 | Lyren | F41G 3/08 42/135 |
| 2017/0146319 | A1 * | 5/2017 | Lyren | G06T 7/20 |

* cited by examiner

*Primary Examiner* — Daniel A Hess

(57) ABSTRACT

A point of aim shows where a weapon is aimed on a target. An electronic device determines an impact location on the target of a projectile fired from the weapon, determines a distance from the point of aim to the impact location, and moves the point of aim in order to sight the weapon to the target.

20 Claims, 15 Drawing Sheets

| Shooting Condition | Data |
|---|---|
| Distance to target | 300 yards |
| Weapon | M4 Carbine |
| Location | Camp Pendleton, San Diego |
| Outdoor temperature | 70° Fahrenheit |
| Altitude | Sea level |
| Wind speed | None |
| Wind direction | None |
| Bore temperature | 70° Fahrenheit |
| Jitter | None |
| Precipitation | None |
| Shooter identification | Not available |
| Shooter history | Not available |
| Ammunition | 5.56 NATO, 2800 fps |

Figure 4B

| Shooting Condition | Data |
|---|---|
| Distance to target | 150 yards |
| Weapon | M4 Carbine |
| Location | Paktia province, Afghanistan |
| Outdoor temperature | 40° Fahrenheit |
| Altitude | 7000 feet above sea level |
| Wind speed | 4 mph |
| Wind direction | Headwind |
| Bore temperature | 40° Fahrenheit |
| Jitter | None |
| Precipitation | None |
| Shooter identification | First Lieutenant E. Lyren |
| Shooter history | 12,000 rounds |
| Ammunition | 5.56 NATO, 2800 fps |

Figure 4C

| Shooting Condition | Sighted | Current | Difference |
|---|---|---|---|
| Distance to target | 300 yards | 150 yards | -150 yards |
| Outdoor temperature | 70° F | 40° F | -30° F |
| Altitude | sea level | 7000 ft | +7000 ft |
| Wind speed | 0 mph | 4 mph | +4 mph |
| Wind direction | none | headwind | headwind |
| Bore temperature | 70° F | 40° F | -30° F |

WEAPON TARGETING SYSTEM

BACKGROUND

Bows and arrows, guns, and other handheld weapons often include a targeting device that assists a shooter in aiming the weapon. For example, some weapons include a scope or a sight to help the shooter aim the weapon in order to hit an intended target.

Advancements in weapon targeting devices and systems will further assist shooters in aiming weapons and hitting intended targets.

BRIEF DESCRIPTION OF THE DRAWINGS

FIG. 4B is a table showing shooting conditions at a first location for an electronic scope sighted to a firearm in accordance with an example embodiment.

FIG. 4C is a table showing shooting conditions at a second location for the electronic scope sighted to the firearm in accordance with an example embodiment.

SUMMARY OF THE INVENTION

One example embodiment is a weapon targeting system.

Another example embodiment includes an electronic device that moves or adjusts a point of aim of a weapon in order to sight or zero the weapon to a target.

Another example embodiment includes an electronic device that moves or adjusts a point of aim of a weapon to compensate for shooting conditions.

Other example embodiments are discussed herein.

DETAILED DESCRIPTION

Example embodiments include systems, apparatus, and methods that include one or more of a weapon, an electronic sighting device, an electronic device, and a weapon targeting system.

An example embodiment moves or adjusts a point of aim of a weapon in order to sight or zero the weapon to a stationary target or to a moving target. For example, if a projectile fired from the weapon misses the target or hits the target at unintended location (such as hitting a target at an impact location that does not correspond with a point of aim), an adjustment is made to an electronic sighting device so the weapon is sighted or zeroed to the target. A subsequent shot fired from the weapon will have an impact location on the target that aligns with the point of aim on the target. A weapon and an electronic sighting device can be sighted with a single shot even if the shot does not hit the target.

The point of aim can also be moved or adjusted to compensate for one or more shooting conditions. For example, if a weapon and electronic sighting device are properly sighted or zeroed for a given distance, an external condition (such as wind, bore temperature, jitter, change in ammunition, etc.) can cause a shot fired from the weapon to miss a target at this distance. An adjustment to the point of aim occurs so the shot hits the target at a location where the weapon is aimed.

The point of aim can also be moved or adjusted to compensate for relative movement between a weapon and a target. For example, if a weapon and electronic sighting device are properly sighted or zeroed for a given distance, a shot fired from the weapon can miss a target at this distance if the target is moving and/or if the weapon is moving. An adjustment to the point of aim occurs so the shot hits the target at a location where the weapon is aimed.

The point of aim can also be moved or adjusted to compensate for a crosswind.

This adjustment includes calculating a direction of a point of aim or line of sight of the weapon relative to or with respect to a direction and speed of the wind. Adjustments to the point of aim are made in real time while the weapon moves and changes a direction of aim with respect to the direction of the wind.

Figure 1:
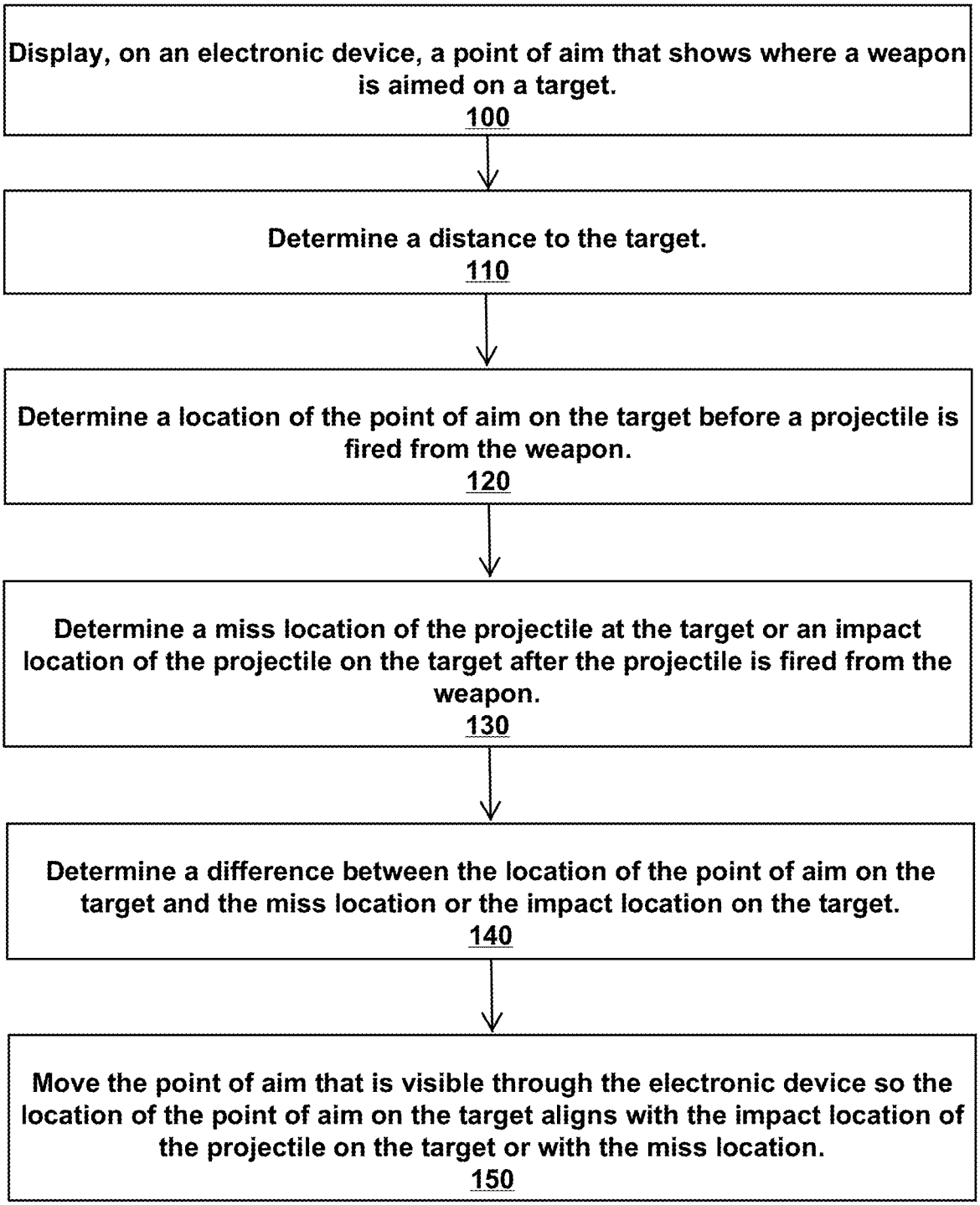
FIG. 1 is a method to move a point of aim that is displayed on an electronic device in accordance with an example embodiment.

FIG. 1 is a method to move a point of aim that is displayed on an electronic device.

Block 100 states display, on an electronic device, a point of aim that shows where a weapon is aimed on a target.

The point of aim can be displayed on a display of the electronic device and/or seen through the electronic device (such as the point of aim being displayed or seen as crosshairs, reticles, a dot, or other point of aim seen through an electronic scope or sight). For example, the point of aim appears as an image on a display, in an electronic scope, on a lens, on the target itself, as a projection, or in an area or space (e.g. space located between the weapon and the target). For instance, a two-dimensional (2D) or three-dimensional (3D) image presents the point of aim. As another instance, a laser spot, infrared spot, or source of electromagnetic radiation appears on the target. As another example, a visual indication appears on a display of a wearable electronic device (WED) or a pair of wearable electronic glasses (WEG) that a shooter wears while aiming a weapon at the target. The visual indication coincides with where the weapon is aimed at a location on a target that is along the line of sight of the weapon. This visual indication or point of aim appears to the shooter to be located on the target. The visual indication, however, is not actually located on the target but appears on the display of the WED or WEG. Alternatively, the visual indication can be located on the target.

Consider an example in which the point of aim appears as visual indicia or as a visual indication (such as a circle, a dot, reticles, crosshairs, image, or visual indicia) that appears on a display of an electronic device that communicates with a weapon aimed at a target and/or communicates with a weapon targeting system. This indicia or indication moves with movement of the weapon in order to show in real-time an impact location or a point of impact (POI) for a projectile fired from the weapon. In addition to showing the indicia or indication, the display also displays a field of view of the weapon and/or a shooter, and this field of view includes a selected physical target that is located away from the electronic device and the shooter. The display of the electronic device displays the indicia or indication such that it appears on, over, or with the selected physical target (such as a target located several hundred meters away from the shooter and the weapon).

Consider an example in which an electronic sighting device (such as an electronic tactical weapons scope) mounts to a weapon and places a point of aim (such as a dot, crosshairs, or other image) on a display in the scope to indicate where the weapon is aimed on a target.

Block 110 states determine a distance to the target.

An electronic or mechanical device measures a distance from a weapon or a projectile to the target and provides this distance to a shooter, the weapon, an electronic device, and/or an electronic sighting device (such as an electronic scope or electronic sight). For example, a laser rangefinder determines a distance to the target. As another example, a mil dot scope or milliradian scope provides information to determine a distance to a target. As another example, global positioning satellite (GPS) coordinates or satellite position information provides a distance to a target. As yet another example, a camera determines a distance to the target. As yet another example, a user provides or inputs a distance to a target. As yet another example, a radio transmitter and receiver use radio waves or electromagnetic waves to determine a distance to the target and/or a speed of the target.

The electronic or mechanical device can be a separate device (such as a standalone device) or device integrated with or attached to the weapon, the projectile, or another electronic device. For example, electronic and/or mechanical devices in a bow or a firearm determine a distance to a target. As another example, electronic and/or mechanical devices in one or more of a wearable electronic device (WED), handheld portable electronic device (HPED), computer, server, and a satellite determine a distance to the target.

An electronic device used to measure a distance to the target or a separate electronic device measures a speed or velocity of the target or velocity of the weapon with respect to the target. Velocity is a rate of change of position of an object and includes a vector of magnitude and direction. A scalar value of velocity or magnitude of velocity is speed. A change in speed and/or direction indicates that an object is undergoing acceleration.

Block 120 states determine a location of the point of aim on the target before a projectile is fired from the weapon.

By way of example, an electronic device captures an image and/or video of the target and where the point of aim is located on or with respect to the target before the projectile is fired from the weapon. As another example, the electronic device marks, stores, and/or calculates a location of the point of aim on the target. For instance, the target may have a distinguishable or recognizable area, location, or feature, and the point of aim was directed on this area, location, or feature before the projectile was fired from the weapon. As another example, object recognition software or program assists in identifying the target and/or a location on the target as the point of aim.

Block 130 states determine a miss location of the projectile at the target or an impact location of the projectile on the target after the projectile is fired from the weapon.

If the projectile impacts the target, then an electronic device captures an image and/or video of the target and where the projectile actually hit, struck, or impacted the target. As another example, the electronic device examines and/or analyzes the target for a mark or visible indication of impact of the projectile on or near the target. For instance, the target may have a distinguishable or recognizable area, location, or feature that was disrupted, changed, altered, or marked from the projectile. As another example, object recognition software or program assists in identifying the location of impact of the projectile on or near the target.

If the projectile misses the target, then an electronic device determines a miss location at the target. For example, the miss location is located at, near, or adjacent to the target where the projectile misses the target.

Consider an example in which a rifle shoots a bullet at a target that is located three hundred (300) yards away from the rifle. The bullet misses the target and passes six inches above the target. The miss location is the location six inches above the target. This location is along the trajectory path of the bullet and located adjacent to the target three hundred yards from the weapon.

When the projectile misses the target, the electronic sighting device, the weapon, a weapon targeting system, or an electronic device determines the miss location. For example, the projectile strikes an object adjacent to the target, and this strike location enables a determination to be made as to the miss location. As another example, analysis of a vapor trail or trace of the projectile shows the miss location. As another example, a human (such as a spotter or person in communication with the weapon targeting system, weapon, or electronic sighting device) provides information as to the miss location.

Block 140 states determine a difference between the location of the point of aim on the target and the miss location or the impact location on the target.

By way of example, a difference exists when the location of the point of aim on the target does not coincide or align with the impact location on the target. A difference also exists when the location of the point of aim on the target does not coincide with the miss location. These situations occur when the projectile fired from the weapon does not hit the target where the electronic scope or sights indicated. For example, the electronic scope and the weapon are not properly sighted or aligned, an internal ballistic condition causes the projectile to miss, or and/or an external ballistic condition causes the projectile to miss.

By way of example, an electronic device determines, measures, calculates, estimates, approximates, or obtains the difference between the point of aim and the impact location or the miss location. For instance, this difference can be measured or approximated as a distance between the point of aim and the impact location or miss location (such as measured in millimeters, centimeters, meters, inches, feet, yards, etc.). Furthermore, this distance can be measured or approximated as a relative spatial relation between two points (such as measured in radians or degrees). A size and/or shape of a known object (such as the target or an object near or proximate the target) can assist in determining a size of the impact location, a distance between the impact location or miss location and the point of aim, or a relative coordinate position between the impact location or miss location and the point of aim.

Triangulation and/or trigonometric identities or functions can also be used to calculate distances between two or more objects and/or two or more points. For example, a laser determines a distance from the weapon to the point of aim and a distance from the weapon to the impact location. Knowing these two distances and a relative angle between them, geometry and/or trigonometry are used to calculate the distance between the point of aim and the impact location. This distance can include a distance in the X-direction, a distance in the Y-direction, and a distance in the Z-direction.

Consider an example in which the distance (D) between two points (X1, Y1) and (X2, Y2) is given by the following equation:

$$D=\sqrt{(X2-X1)^2+(Y2-Y1)^2}.$$

Consider another example in which a longitude and latitude are known for two points. A distance calculator uses these coordinates to find a distance between the two points.

Block 150 states move the point of aim that is visible through the electronic device so the location of the point of aim on the target aligns with the impact location of the projectile on the target or with the miss location.

Example embodiments adjust a location of the point of aim so it shows the actual impact location or point of impact where the projectile will impact an object at which the weapon is aimed. The point of aim is adjusted so it occurs along the actual trajectory path of the projectile. For example, when a shooter aligns the crosshairs of an electronic scope on a target, the impact location of the projectile fired from the weapon will impact the target at the location of the crosshairs.

Movement of the point of aim is based on one or more of the distance to the target, the difference between the location of the point of aim on the target and the location of the impact location on the target, the difference between the location of the point of aim on the target and the miss location, and an angle or degree or reference of separation between the point of aim and the impact location or miss location.

An example embodiment can adjust the point of aim even when a projectile fired from the weapon does not hit the target or even hit another visible object. Consider an example in which a shooter fires a bullet from a rifle at a target that is located one hundred (100) yards from the shooter. The bullet misses the target, continues to travel several miles, and enters woods that are not visible to the shooter. The bullet leaves a vapor trail and disrupts a mirage that exists between the shooter and the target. A weapon targeting system captures, records, and analyzes the vapor trail and disruption to the mirage in order to calculate a miss location. This miss location shows that the bullet passed two inches directly above the target.

Consider an example in which an electronic scope is mounted to a firearm (such as a rifle or other handheld firearm). The firearm is aimed on a bullseye location on a target, and the electronic scope includes crosshairs that show a point of aim of the firearm is aimed on the bullseye location. The firearm fires when the point of aim or crosshairs are on the bullseye location, but the bullet misses the bullseye location and impacts the target elsewhere at an impact location. The electronic scope determines a distance to the point of aim, a distance to the impact location, and an angle between imaginary lines drawn from the weapon to the point of aim and impact location, calculates a distance between the impact location of the bullet and the bullseye location or point of aim, and calculates a direction from the point of aim to the impact location. Based on these calculations, the electronic scope moves the crosshairs that are visible through the scope in order to sight or to zero the firearm such that subsequent bullets fired from the firearm impact the target at locations at the point of aim (i.e., at locations where the crosshairs are located on the target). For example, when the crosshairs are positioned on the bullseye location and the firearm is fired, the bullet will impact the target at the bullseye location where the crosshairs were positioned as seen through and/or displayed on the electronic scope. The electronic scope and firearm are now sighted or zeroed.

Consider an example in which a hunter attempts to sight his rifle or far zero sight his rifle on a target located two hundred (200) yards away. An electronic scope connected to the rifle includes a display that shows a red dot as a point of aim. When the red dot is located on the target, the hunter fires the rifle. At this instant in time, a camera in the electronic scope captures an image of the target to show where the red dot was located or positioned on the target. After the bullet impacts the target, the camera captures another image of the target to show where the bullet impacted the target. A comparison between these two images shows the impact location of the bullet on the target is two inches away from where the red dot was located or positioned at the instant the rifle was fired. This comparison further reveals that the impact location of the bullet is one hundred and ten degrees (110°) from where the red dot was located. A rangefinder in the electronic scope determines that the target is two hundred yards away. Based on this distance (i.e., two hundred yards) and the comparison information (i.e., two inches at one hundred and ten degrees), the electronic scope adjusts a location of the red dot that appears in the display. This adjusted point of aim sights the electronic scope such that a subsequent bullet fired from the rifle will hit the target at the location of the red dot (i.e., at the location of the point of aim of the rifle). The hunter was able to sight the rifle and electronic scope after a single shot. In other words, the electronic scope synchronized the point of aim and the impact location or sighted the electronic scope after analysis of a single shot fired from the rifle. The electronic scope stores and/or wirelessly transmits this adjusted point of aim for subsequent aiming, sighting, calibration, and/or firing of the rifle.

Consider an example in which a rifle and an electronic scope are not sighted or zeroed together. A hunter fires the rifle at a deer three hundred yards away when crosshairs of the electronic scope are above a front shoulder of the deer. Video image of the shot indicates that the bullet struck the deer in its stomach at a location this is parallel to the crosshairs with respect to ground. Object recognition software identifies the target as a male buck deer having an antler with four points. The electronic scope retrieves from a database an average size of a male deer in this geographical area with an antler having four points. Based on this average size, a distance to the deer (i.e., three hundred yards), and the video images, the electronic scope calculates a distance of fourteen inches (14") to be the distance between a location of where the crosshairs were the instant the hunter fired and the location where the bullet struck the deer in the stomach. The crosshairs are moved or adjusted in the electronic scope to compensate for the misalignment of the point of aim of the rifle and the electronic scope.

Consider an example in which an electronic scope is mounted to and sighted with a rifle. The electronic scope, however, is bumped during transit and hence no longer sighted with the rifle. A soldier retrieves the rifle, fires at a target, and misses since the electronic scope and weapon are no longer sighted together. A small puff or plume of debris appears at an impact location near the target where the bullet struck. The electronic scope determines a distance and direction between the point of aim and the impact location and adjusts the point of aim of the electronic scope so it is sighted with the rifle on subsequent shots.

Consider an example in which a soldier aligns a point of aim of an electronic scope on his rifle on a target that is one hundred yards away and fires a single shot at the target. The bullet hits the target but is one inch directly below a location of where the point of aim was located on the target when the bullet was fired. A weapon targeting system adjusts or moves the point of aim so the rifle is sighted or zeroed at one hundred yards. The soldier fires a second shot at the target, and this second shot hits the target at the exact location where the point of aim was located when the shot was fired. The soldier then aims the rifle at a second target that is three hundred yards away. The weapon targeting system determines this distance and automatically alters the point of aim so the rifle is sighted or zeroed at three hundred yards. The soldier fires his third shot at the second target, and this third shot hits the target at the exact location where the point of aim was located when the shot was fired.

Traditionally, a shooter leads a moving target while aiming at and firing on the target. Lead is the distance a target moves from the moment a shooter pulls a trigger or activates a weapon to fire to the moment the shot reaches the target. During this time, the target moves. In order to compensate for this movement, a shooter can lead a target (e.g., aim the weapon in front of the moving target in order to compensate for the time required for the shot to travel to the target).

An example embodiment calculates lead for a moving target and adjusts the point of aim so a shooter does not have to lead a target. Instead, the shooter places the point of aim on the moving target and fires the weapon. A projectile fired from the weapon will hit the moving target at the location of the point of aim on the moving target. An adjustment of the point of aim includes a compensation for lead of the moving target.

Consider an example in which a rifle has an electronic scope that includes a distance determiner that measures a distance to a target and determines a velocity of the target. Based on the distance to the target, the velocity of the target (speed and direction), and muzzle velocity of ammunition in the rifle, the electronic scope calculates a time required for the bullet to reach the target and positional change of the target during this time. The electronic scope then adjusts a point of aim (such as the crosshairs in an electronic scope mounted to the rifle) to compensate for the moving target. In order to hit the moving target, a shooter is not required to lead the target (i.e., not required to place the crosshairs in front of the moving target to compensate for its movement). Instead, the crosshairs are adjusted in the electronic scope to compensate for the lead. In order to hit the moving target, the shooter places the crosshairs on the target and fires the rifle. The bullet will strike the target at the position of the crosshairs since the electronic scope already compensated for lead and the moving target.

Adjustments to the point of aim occur in real time and change in response to changes to the speed of the target, the direction of the target, and/or the distance to the target. Adjustments can also occur if the weapon itself is moving since speed is relative and calculated relative to the weapon and the target.

Consider an example in which a hunter aims his rifle with an electronic scope on a deer that is standing still. The hunter positions a point of aim on the deer such that crosshairs in the electronic scope are on the deer. A weapon targeting system determines shooting conditions (including a distance to the target, wind, and other environmental conditions) and calculates a point of aim on the deer so the crosshairs coincide with an impact location when the hunter fires the rifle. The deer becomes alarmed and begins to trot. As the deer moves, the weapon targeting system recalculates the point of aim to compensate for the trotting deer and moves or adjusts the crosshairs based on the speed and direction of the deer. The deer transitions from a trot to a run, and the weapon targeting system recalculates the point of aim to compensate for the running deer. While the dear is running, the hunter places the crosshairs on the deer and fires the rifle in order to hit the moving deer at the location of the crosshairs. The hunter is not required to lead the running deer since the point of aim corresponds and aligns with the impact location of a moving object.

Figure 2:
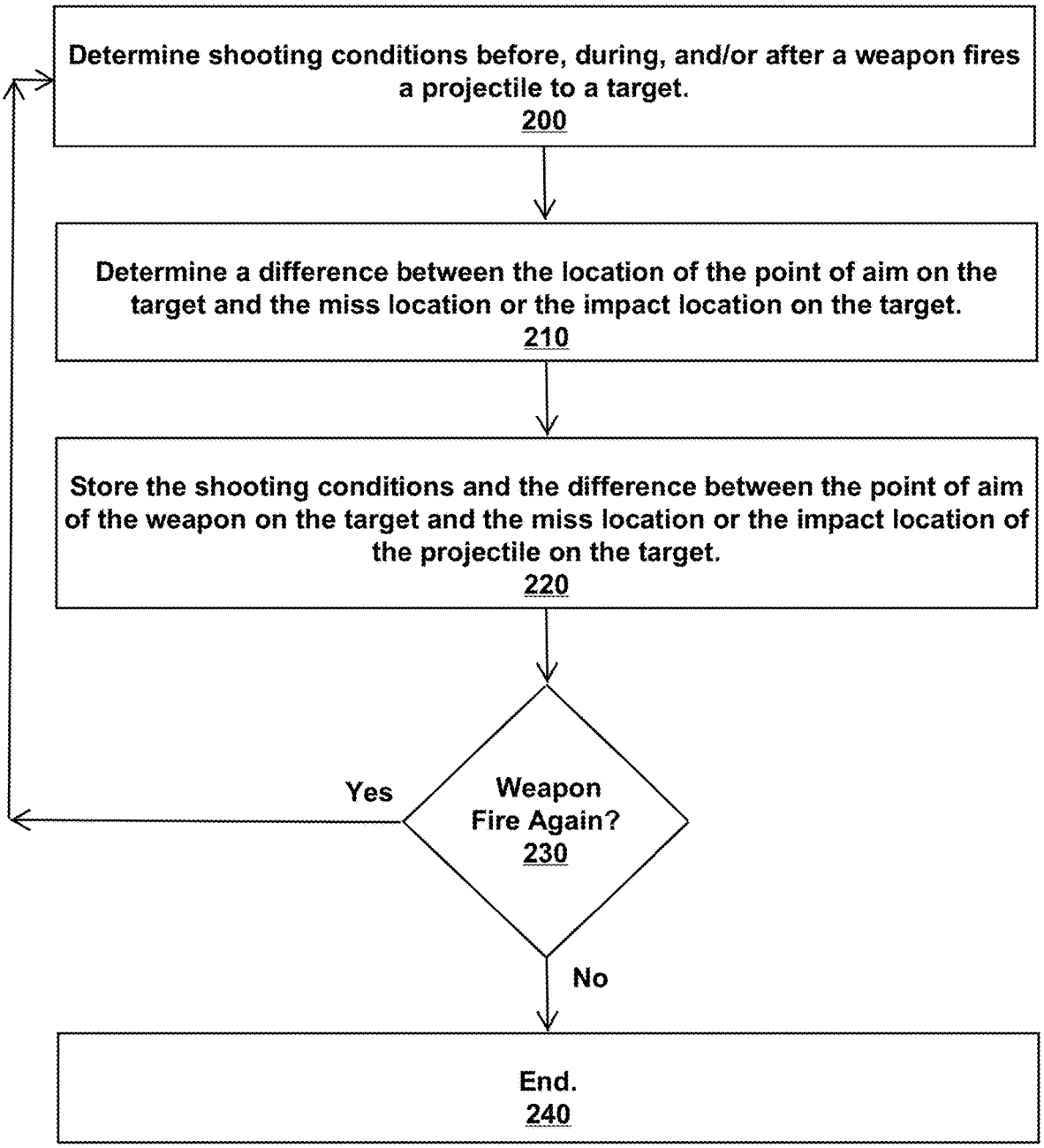
FIG. 2 is a method to store shooting conditions when a weapon fires a projectile in accordance with an example embodiment.

FIG. 2 is a method to store shooting conditions when a weapon fires a projectile.

Block 200 states determine shooting conditions before, during, and/or after a weapon fires a projectile to a target.

Shooting conditions include one or more of environmental or ambient conditions, conditions relating to the weapon, conditions relating to the shooter or to the target, conditions relating to the projectile, conditions relating to an electronic scope, and conditions relating to an electronic device connected to or in communication with the weapon, the shooter, the projectile, or the electronic scope. By way of example, the shooting conditions include, but are not limited to, type or make or model or specifications of an electronic scope or electronic sighting device or projectile or weapon, an identity of the shooter (including tendencies, shot patterns, historic actions of shooting, jitter, height, weight, age, gender, eyesight or vision quality or correction, shooting experience, shots fired, etc.), a geographical location of the weapon, bore temperature of the weapon, a physical or mental condition of the shooter, information gathered from previous projectiles launched from the weapon (such as images or video), information concerning a target, vapor trails, mirages, shot patterns, wind direction, wind speed, humidity, altitude, atmospheric pressure, precipitation, temperature where the weapon is being fired, ballistic information (including internal and external ballistics), and ballistic trajectories and projectile flight paths.

Block 210 states determine a difference between the location of the point of aim on the target and the miss location or the impact location on the target. This block is discussed above in FIG. 1 with respect to block 140.

Block 220 states store the shooting conditions and the difference between the point of aim of the weapon on the target and the miss location or the impact location of the projectile on the target. For example, this information is stored in memory, processed, and/or wirelessly transmitted over a network to an electronic device.

Block 230 makes a determination as to whether the weapon fires again. If the answer to this determination is "no" then flow proceeds to block 240 and ends. If the answer to this determination is "yes" then flow proceeds back to block 200.

Consider an example in which a weapon is shot several hundred times. Each time the weapon fires, the shooting conditions and the difference between the point of aim of the weapon on the target and the miss location or the impact location of the projectile on the target are stored in memory.

Figure 3:
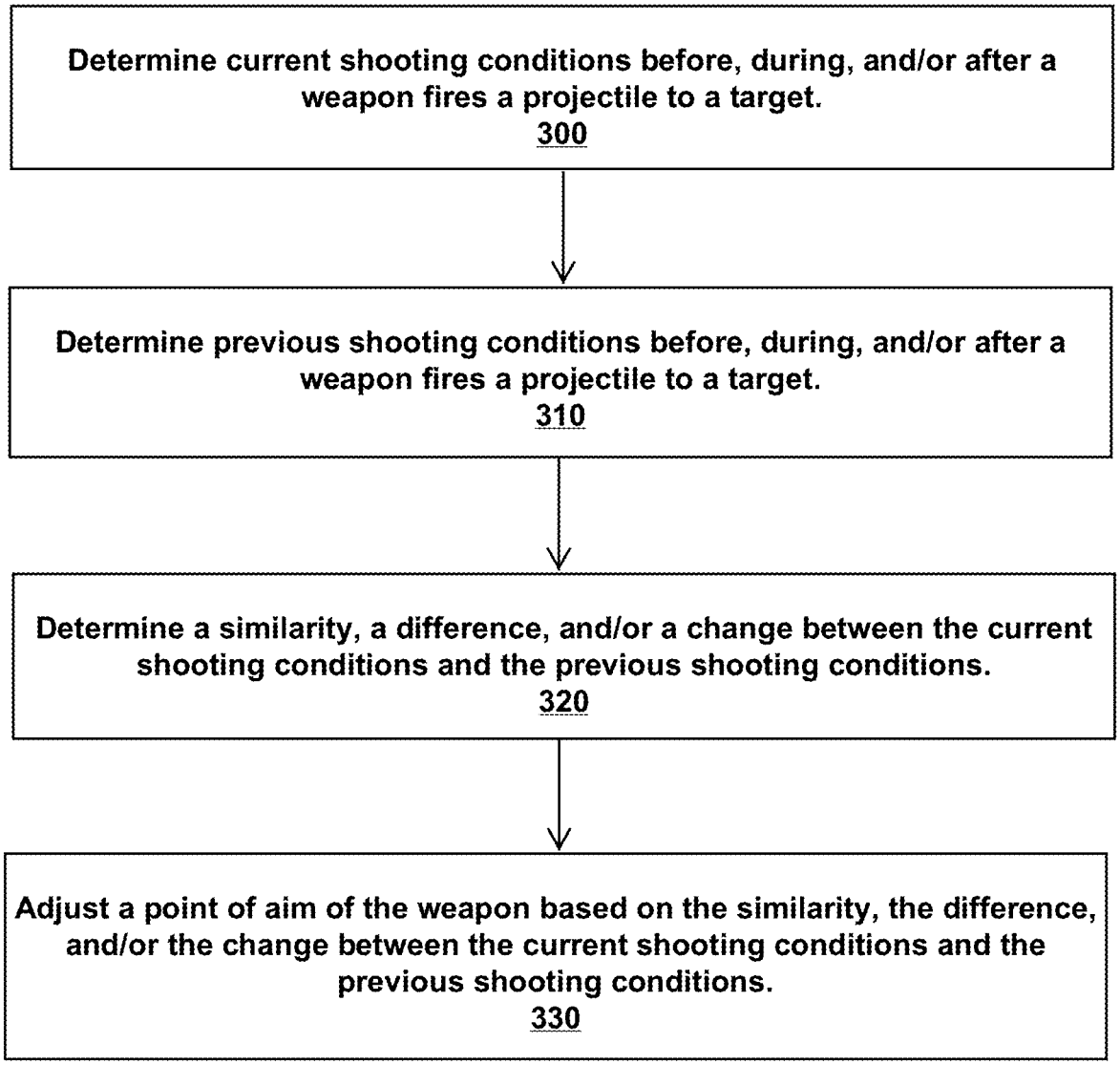
FIG. 3 is a method to adjust a point of aim of a weapon based on shooting conditions in accordance with an example embodiment.

FIG. 3 is a method to adjust a point of aim of a weapon based on shooting conditions.

Block 300 states determine current shooting conditions before, during, and/or after a weapon fires a projectile to a target. This block is discussed above in FIG. 2 with respect to block 200.

Block 310 states determine previous shooting conditions before, during, and/or after a weapon fires a projectile to a target.

For example, an electronic device retrieves, receives, or obtains previous shooting conditions stored in memory or transmitted from an electronic device. These previous shooting conditions include shooting conditions that occurred during a previous time or event or during a current time or event.

Consider an example in which a firearm shoots several hundred rounds while being located at a first geographical location and having a set of shooting conditions (such as a specific outdoor temperature, barometric pressure, ammunition type, shooter identity, wind speed and direction, barrel length on the firearm, distance to target, etc.). Several days later the firearm begins to shoot rounds while being located at a second geographical location and having a different set of shooting conditions. The weapon, electronic sighting device, and/or weapon targeting system stores these shooting conditions for each geographical location.

The previous shooting conditions also include the shooting conditions that occurred at the last shot fired from the weapon. For example, a weapon fires a first round and records the shooting conditions for this first round. Several seconds later, the weapon fires a second round and records the shooting conditions for this second round. In this manner, the weapon records the shooting conditions for each round that the weapon fires.

Consider an example in which a weapon targeting system continuously, continually, or periodically records shooting conditions while the weapon targeting system is active. The weapon targeting system, weapon, and/or sighting device would know current, real time shooting conditions at any point in time and make adjustments to a point of aim based on these shooting conditions. For instance, while the weapon is sitting in a vehicle, the weapon targeting system continues to gather and store current or present shooting conditions. A soldier grabs the weapon from the vehicle and quickly fires the weapon at a target. The current shooting conditions would be analyzed, processed, and used to properly sight the weapon for this shot. The shot fired from the weapon would hit the target at the location indicated by the point of aim since the weapon was automatically zeroed for the target under the current shooting conditions.

Block 320 states determine a similarity, a difference, and/or a change between the current shooting conditions and the previous shooting conditions.

By way of example, a comparison of the current shooting conditions with the previous shooting conditions reveals similarities, differences, or changes between the two shooting conditions. These similarities, differences, or changes assist in aiming, sighting, targeting, and firing the weapon.

Consider an example in which a soldier fires his weapon while engaged in a firefight. The weapon continually records shooting conditions that include a time and date a shot is fired, a GPS location, an identification of the weapon, an identification of the shooter, an identification of the ammunition, an identification of the target, a distance to the target, a speed of the wind, a direction of the wind, and number of rounds fired. Further, for each round fired, the weapon records bore temperature, a vapor trail, mirage disruption, miss location (if a miss occurred), an impact location (if a hit occurred), an image or video of the target and/or direction of aim, a timestamp when the shot occurred, a GPS location, audio, a direction of a point of aim of the weapon, whether the round hit or missed the target, and settings or adjustments that were made to the point of aim (e.g., adjustments made by the weapon targeting system, the weapon, the sighting device, and/or the shooter or another electronic device). Each time the weapon discharges a round, a different set of shooting conditions would occur.

Some of these shooting conditions would be similar or the same (such as the identification of the weapon or the shooter), while other shooting conditions would change (such as the timestamp, vapor trail, bore temperature, direction of the point of aim, etc.). These shooting conditions can be stored, transmitted, processed, analyzed, and/or displayed.

Block 330 states adjust a point of aim of the weapon based on the similarity, the difference, and/or the change between the current shooting conditions and the previous shooting conditions.

For example, the point of aim is adjusted to reflect or include the current shooting conditions. These current shooting conditions can include an analysis or assessment of previous shooting conditions as well (such as differences, similarities, and/or changes).

In an example embodiment, the point of aim repeatedly updates in order to improve the accuracy of the shooter to hit targets and to improve calibration of the weapon to the sighting device. When a shooting condition changes, a determination is made as to whether the weapon and/or the electronic sighting device should be changed or adjusted to compensate for this change to the shooting condition. If the change to the shooting condition is minimal or insignificant, then no change occurs to the settings of the weapon and/or electronic sighting device. For instance, a change to the shooting conditions includes a soldier and weapon moving from one tree to an adjacent tree while engaging in a firefight with no wind, and this change in location has little or no impact on the current settings of the weapon and/or electronic sighting device.

Later though, a change to the shooting conditions includes the soldier and the weapon engaging in a firefight with a 20 mile per hour (mph) crosswind. This change in the wind would have an impact on the current settings of the weapon and/or electronic sighting device. The point of aim on the weapon would be adjusted to compensate for the 20 mph crosswind so the weapon continually remained sighted or zeroed with the electronic sighting device regardless of the change to the shooting conditions.

Figure 4A:
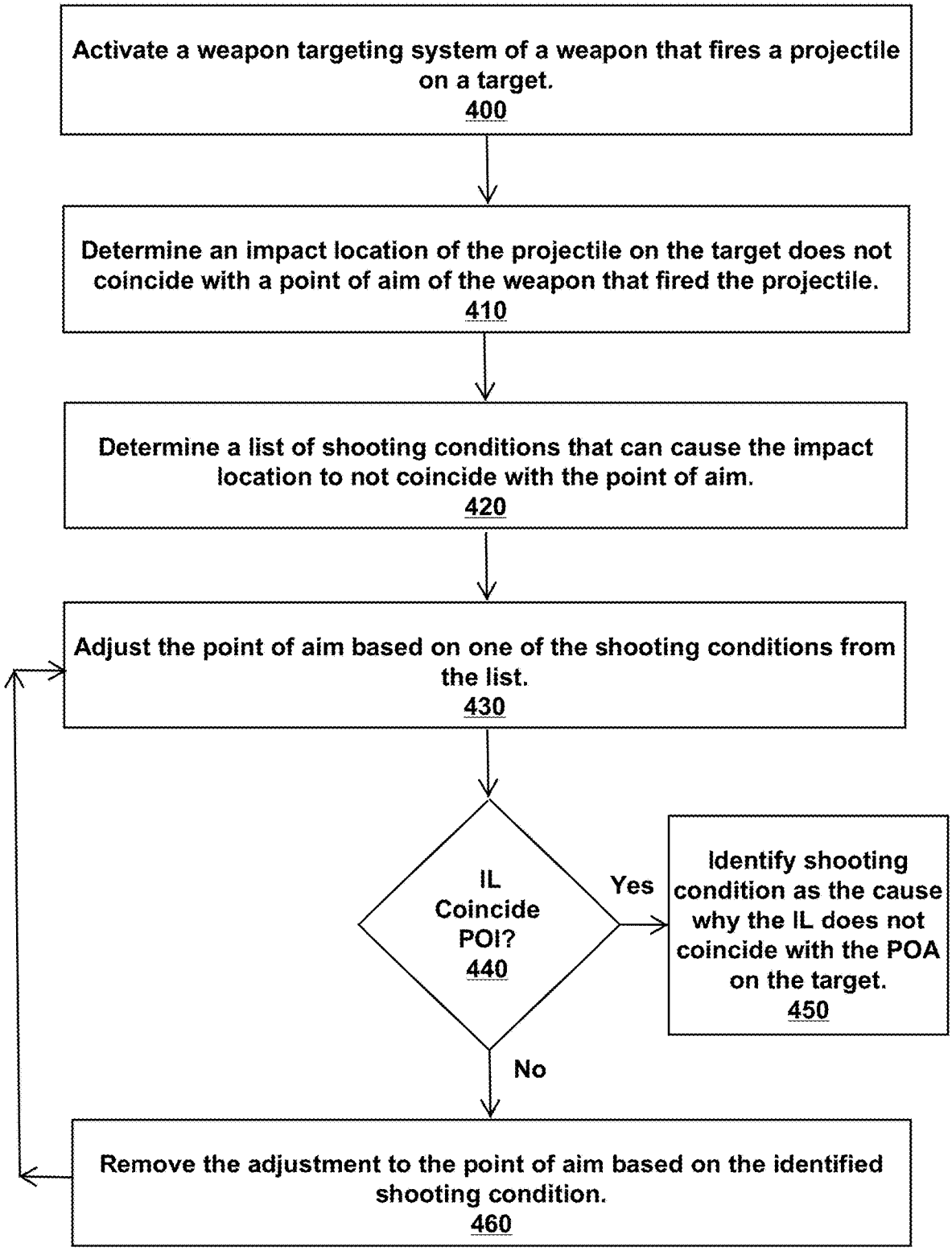
FIG. 4A is a method to determine a cause why an impact location of a projectile on a target does not coincide with a point of aim on the target of a weapon that shot the projectile in accordance with an example embodiment.

FIG. 4A is a method to determine a cause why an impact location of a projectile on a target does not coincide with a point of aim on the target of a weapon that shot the projectile.

Block 400 states activate a weapon targeting system of a weapon that fires a projectile on a target.

The weapon targeting system can be activated manually or automatically. For example, a shooter activates the weapon targeting system with a finger, hand, voice, or human effort. For instance, the weapon and/or sighting device (such as an electronic scope) includes one or more of hardware, software, electronics, a user interface, a sensor, a switch, a trigger, or a mechanism to turn the weapon targeting system on and off. By way of example, a shooter places his finger or hand at a predetermined location on the weapon to activate the weapon targeting system. As another example, a shooter pulls a string of a bow back with an arrow engaged, and this action activates the weapon targeting system. As yet another example, the weapon targeting system automatically activates at a certain time of day, at a certain geographical location, when the weapon is in a certain physical orientation, when the weapon is gripped, when the weapon determines a presence of a target, when the weapon is aimed at a target, when the weapon is loaded with ammunition, etc. As yet another example, a user interacts with a handheld portable electronic device (HPED), wearable electronic device (WED), or electronic device that communicates with the weapon in order to activate the weapon targeting system. As yet another example, the weapon targeting system activates or turns on when a weapon and/or electronic scope activates or turns on and deactivates or turns off when the weapon and/or electronic scope deactivates or turns off.

Consider an example of a weapon or sighting device (such as an electronic scope) that includes or communicates with a weapon targeting system. When the weapon aims to a location on the ground that is proximate or near the weapon or a user, then the weapon targeting system deactivates. When the weapon aims to a location away from the ground or to a target, then the weapon system activates. Alternatively, the weapon targeting system continues to remain active (e.g., remains active while a sighting device is mounted to a weapon, remains active all day and all night, remains active when the weapon is gripped or held, remains active during specified hours, or remains active at times as instructed by a human or electronic device).

Consider an example in which the weapon targeting system includes software or programming code that executes on a handheld portable electronic device (HPED), a weapon with electronics, and/or on an electronic scope mounted to the weapon. The HPED communicates with the electronic scope and/or weapon in order to perform functions such as activating and deactivating the electronic scope or weapon or weapon targeting system of the electronic scope or weapon, adjusting a point of aim of the electronic scope, uploading data to the electronic scope or weapon, downloading data from the electronic scope or weapon, determining or analyzing shooting conditions, instructing the weapon to fire or not fire, and performing other methods discussed herein.

Block 410 states determine an impact location of the projectile on the target does not coincide with a point of aim of the weapon that fired the projectile.

An inaccurate shot or a miss occurs when the weapon discharges a projectile but the projectile does not strike the location where the weapon is aimed. For example, a firearm (such as a rifle or a handgun) includes a scope with crosshairs that show where the firearm is aimed. A bullet fired from the firearm does not hit where an object at a location of the crosshairs but misses. The crosshairs of the scope do not provide an accurate indication where the bullet will hit the target. The impact location of the bullet does not coincide with a point of aim of the firearm. For example, a miss location occurs.

Consider an example in which the weapon targeting system records or stores a location of the point of aim of a weapon immediately before or right when a projectile is fired from the weapon. This record shows where on an object the weapon was aimed at the time the projectile was fired from the weapon. The weapon targeting system then records or stores an impact location where the projectile struck or hit the object or a miss location. The weapon targeting system analyzes the location of the point of aim and the impact location or miss location to determine if a miss or a hit occurred. A miss or unsuccessful shot on the object occurs when the location of the point of aim does not coincide with or align with the impact location. A hit or a successful shot on the object occurs when the location of the point of aim coincides with or aligns with the impact location.

A hit or a successful shot on the object can also occur when the location of the point of aim does not coincide with or align with the impact location but the impact location is within a specified or predetermined distance from the point of aim. For instance, this specified or predetermined distance can be few millimeters, a few centimeters, a few inches, a few feet, a few yards, etc. This specified or predetermined distance can vary and be based on a distance from the weapon to the target, such as one eighth of an inch for every hundred yards (e.g., a target distance of 100 yards has an acceptable range of ⅛ inch circumference from the point of aim; a target distance of 200 yards has an acceptable range of ¼ inch circumference from the point of aim; a target distance of 300 yards has an acceptable range of ⅜ inch circumference from the point of aim, etc.).

Consider an example in which a firearm shoots at a target that is 250 yards away. The target has a mark or an identifying feature that represents a desired target impact location (DTIL). The firearm fires when crosshairs of a scope on the firearm align with this mark or identifying feature. The bullet fired from the firearm misses the mark or identifying feature, but hits the target three inches above the mark or identifying feature. The weapon targeting system compares the point of aim and impact location, determines that the bullet missed three inches above the point of aim, analyzes the shooting conditions, and determines the miss is attributed to shooter jitter. Given the size, shape, location, and identification of the target, the miss of three inches above the mark or identifying feature is considered a successful shot. No adjustments are made to the point of aim, but the miss, jitter, images, and other shooting conditions are stored and identified with the shooter and firearm.

Block 420 states determine a list of shooting conditions that can cause the impact location to not coincide with the point of aim.

For example, the weapon targeting system can receive, retrieve, or obtain the list of shooting conditions. For instance, these shooting conditions are stored in memory and retrieved by the weapon targeting system, the weapon, the electronic scope, or an electronic device.

The shooting conditions provide a finite, discernable number of different reasons why an impact location does not coincide with a point of aim. One or more of these shooting conditions provides the cause of the projectile missing the target at the point of aim. An example embodiment can determine the shooting condition that caused an impact location to not coincide with a point of aim.

Consider an example in which an electronic scope mounts to a rifle, and the electronic scope and rifle are accurately sighted (i.e., far zeroed) for targets at 500 yards. A shooter aligns crosshairs of the electronic scope on a bullseye location of target that is 500 yards away and fires. The bullet misses the bullseye even though the electronic scope is accurately sighted for 500 yards. One or more various shooting conditions can cause the bullet to miss the bullseye. For example, the shot was fired during a sudden cross wind that caused the bullet to miss the bullseye. As another example, the shot was fired at a high altitude (e.g., 10,000 feet) yet the electronic scope was sighted at sea level, and this difference in altitude caused the bullet to miss the bullseye. As another example, the shooter jerked while pulling the trigger on the rifle, and this jerk or jitter caused the bullet to miss the bullseye. As another example, an outdoor ambient temperature was near zero degrees, and the cold bore temperature of the rifle affected the trajectory path of the bullet and caused the bullet to miss the bullseye. As yet another example, the electronic scope and the rifle were sighted with ammunition of 0.03-06 220 grain RN at 2,500 feet per second (fps). The shooter, however, used ammunition of 0.03-06 150 grain Nosier at 2,910 fps. These 150 grain bullets have a different trajectory path than the 220 grain bullets, and this difference caused the 150 grain bullets to miss the bullseye. As yet another example, the shooter has an eye astigmatism or eye defect that causes the shooter to see the crosshairs aligned on the bullseye when in reality the crosshairs are misaligned with the bullseye. This misalignment causes the bullet to miss the bullseye.

Block 430 states adjust the point of aim based on one of the shooting conditions from the list.

The point of aim is adjusted based on one or more of the shooting conditions. An amount or degree of adjustment to the point of aim depends on the selected shooting condition. For example, an adjustment based on a 6 mile per hour (mph) crosswind would be different than an adjustment based on a 12 mph crosswind. As another example, an adjustment based on target being 800 yards from the weapon would be different than an adjustment based on a target being 100 yards from the target.

By way of example, a weapon or an electronic sighting device (such as an electronic scope, WED, WEG, or HPED) provides a point of aim to a shooter of the weapon. The weapon or electronic sighting device moves the point of aim so the weapon is more accurately sighted to the target.

Consider an example in which a firearm includes an electronic scope that displays reticles or a dot to show a point of aim of the firearm. The weapon targeting system moves a location of the reticles or dot being displayed in order to sight the electronic scope and the firearm with a target.

Consider an example in which a shooter wears WEG that communicate with a rifle having electronics. The WEG displays a point of aim that shows where the rifle is aimed and pointed. Analysis of a previous shot fired from the rifle indicates that the point of aim displayed on the WEG does not coincide with where the rifle is aimed and pointed. The WEG moves the point of aim so subsequent bullets fired from the rifle land or hit targets at the point of aim displayed on the WEG.

Block 440 makes a determination as to whether the impact location (IL) coincides with the point of aim (POA) on the next shot. If the answer to this determination is "yes" then flow proceeds to block 450 and the shooting condition is identified as a cause why the impact location of the projectile on the target did not coincide with the point of aim on the target. If the answer to this determination is "no" then flow proceeds to block 460.

Block 460 states remove the adjustment to the point of aim based on the identified shooting condition. Flow then proceeds back to block 430.

A reason for why the weapon misses the desired target impact location may not be initially known. For example, the shooter, the weapon targeting system, the electronic sighting device, and other electronic devices do not know a cause why projectiles fired from the weapon are not striking the target at the desired target impact location. The reason, however, can be determined by identifying one or more possible causes from the list of the shooting conditions and determining which one of these shooting conditions is causing the weapon to miss.

Consider an example in which a shooter aims a rifle with an electronic scope on a target, fires, and misses a bullseye location on the target. A weapon targeting system determines that the crosshairs of the electronic scope were properly positioned on the bullseye location when the rifle was fired, but nonetheless the bullet fired from the rifle did not hit the intended bullseye location on a target. The weapon targeting system determines that the bullet missed the bullseye location for one of five possible reasons or conditions that include jitter, wind, altitude, bore temperature, or ammunition type. The weapon targeting system further determines a probability for each one of these five conditions and assigns a hierarchy or likelihood as follows: wind (first most likely reason: probability 60%), jitter (second most likely reason: probability 30%), altitude (third most likely reason: probability 5%), bore temperature (fourth most likely reason: probability 3%), and ammunition type (fifth most likely reason: probability 2%). Based on the calculated probabilities and the associated hierarchy, the weapon targeting system moves the point of aim (i.e., crosshairs) displayed on the electronic scope. Movement of the point of aimed is based on the cause being wind since wind was the most likely or most probable cause of the miss. A second shot is fired, and the weapon targeting system determines that the impact location of the second bullet hits the target at the bullseye location. The weapon targeting system saves the current position of the crosshairs for the electronic scope, and the rifle continues to fire on target with the current, saved settings. The weapon targeting system saves the cause as wind and displays this cause to the shooter or to another person (e.g., displays the cause of wind on the electronic scope, on WEGs in communication with the rifle, on a WED in communication with the rifle, on a HPED in communication with the rifle).

The weapon targeting system does not have to wait for a miss to occur before making adjustments to the point of aim. Instead, the weapon targeting system can continuously, continually, or periodically monitor and analyze the shooting conditions to make adjustments in real time before, during, or after a weapon is being fired. In this manner, a weapon and electronic sighting device remain sighted or zeroed even while shooting conditions change.

Consider an example in which a point of aim of an electronic scope is sighted with a rifle to hit a bullseye location at 300 yards. The weapon targeting system stores the shooting conditions for this sighting. For instance, the electronic scope and rifle are sighted or zeroed for the shooting conditions shown in FIG. 4B. Later, the rifle and electronic scope are transported to Afghanistan and provided to a soldier for combat. The soldier activates the weapon targeting system, and it identifies and stores the shooting conditions shown in FIG. 4C. The weapon system compares the shooting conditions stored in FIG. 4B with the shooting conditions stored in FIG. 4C and identifies differences between these two shooting conditions. These differences between shooting conditions are shown in FIG. 4D.

Figures 4D, 5:
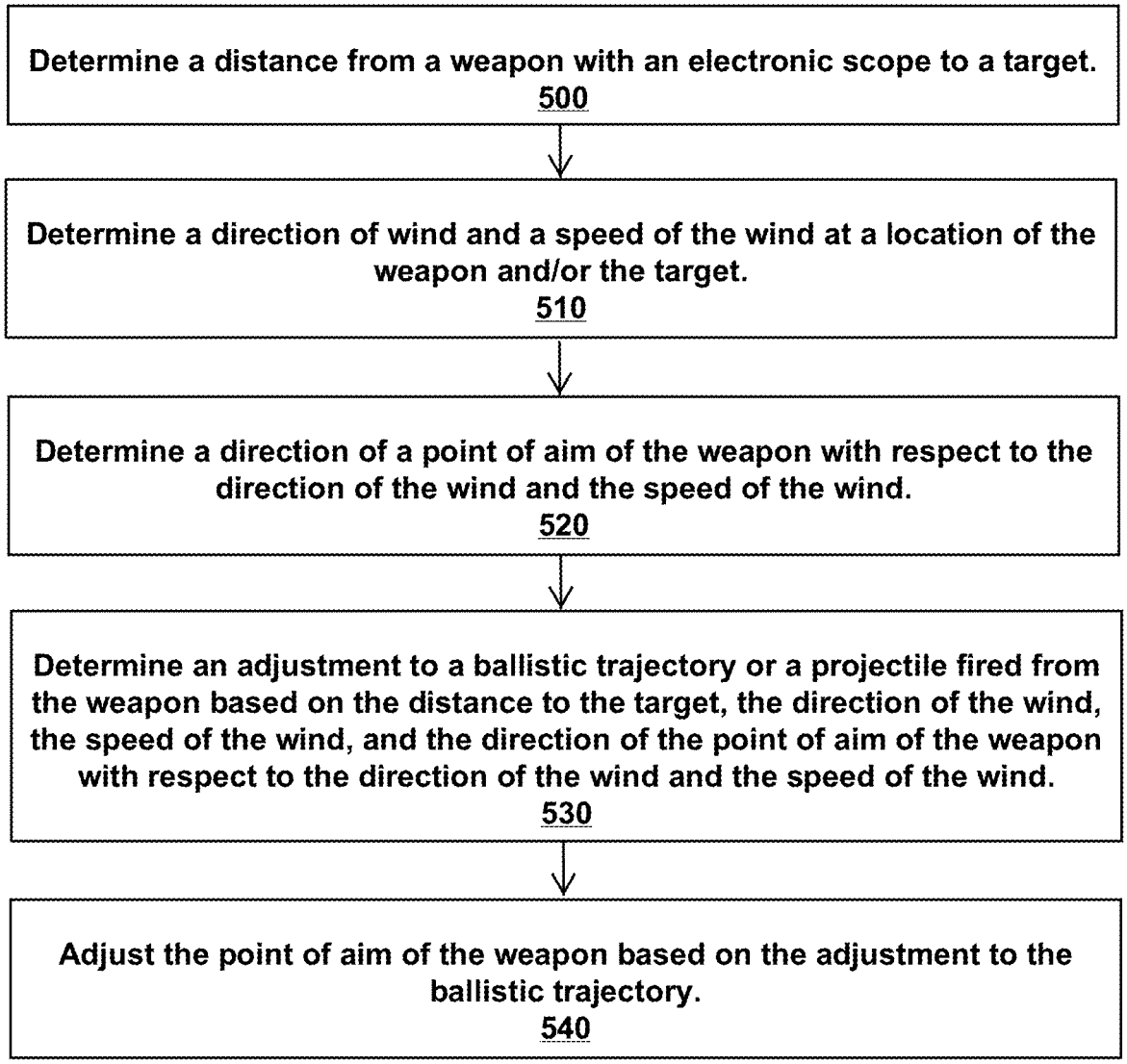
FIG. 4D is a table showing differences between shooting conditions at the first and second locations in accordance with an example embodiment.
FIG. 5 is a method to adjust an electronic sighting device of a weapon in real time based on a direction and speed of wind and a direction of a point of aim of the weapon in accordance with an example embodiment.

Each of these identified shooting conditions in FIG. 4D can affect a trajectory path of bullets fired from the rifle. The weapon targeting system calculates an adjustment for each one of these shooting conditions and then calculates an overall or total adjustment based on these shooting conditions. For instance, the individual adjustments are added, subtracted, or compared to determine a single or a total adjustment, and this single adjustment is applied to the point of aim for the electronic scope. The adjustment is made before the weapon is fired to ensure that the electronic scope and the rifle are sighted when the first shot is fired. For example, the weapon targeting system changes or alters crosshairs in the electronic scope a certain number or amount of minutes of angle (MOA) based on the data in FIG. 4D.

Furthermore, the weapon targeting system continues to monitor the shooting conditions and makes an adjustment to the point of aim in real-time when one or more of the shooting conditions changes.

Consider an example in which the rifle is sighted according to the shooting conditions of FIG. 4C. During a firefight, the rifle moves from shooting at targets 150 yards away to aiming on a target 300 yards away. The weapon targeting system immediately detects this difference in distance in real time and adjusts the point of aim so the electronic scope remains accurately sighted to the rifle and to the target. The shooter is not required to make sighting adjustments based on distance to the target since such the weapon targeting system automatically makes these adjustments in real time as the shooter aims and fires the weapon from one target to the next target.

Consider another example in which the rifle is sighted according to the shooting conditions of FIG. 4C. During a firefight, the weather changes, and the wind speed increases to 20 mph. The weapon targeting system determines a direction of the wind and compares this direction with a relative direction of aim of the rifle.

Adjustments to the point of aim are made in real time depending on the direction of aim of the rifle. For instance, a different adjustment is made when the rifle is aimed into a 20 mph headwind wind as opposed to the rifle being aimed into a 20 mph crosswind. The weapon targeting system immediately detects in real time these different aim directions and adjusts the point of aim so the electronic scope remains accurately sighted to the rifle and to the target. The shooter is not required to make sighting adjustments based on the wind speed and/or wind direction to the target since such the weapon targeting system automatically makes these adjustments in real time as the shooter aims and fires the weapon from one target to the next target.

Ammunition is an example shooting condition. An example embodiment determines a type of ammunition loaded into the weapon and alters the point of aim based on the type of ammunition. This determination includes determining one or more of caliber, grain, shape, sectional density, and a ballistic coefficient. Information in a ballistic table will vary depending on one or more of these factors. For example, a 30 caliber bullet having 180 grain spire point shape with a 0.43 ballistic coefficient will have a different ballistic table than a 30 caliber bullet from the same manufacturer having 180 grain round nose shape with a 0.24 ballistic coefficient.

Consider an example in which a firearm has a sensor that senses or reads a type of ammunition loaded in the firearm and provides this information to a weapon targeting system. The weapon targeting system gathers ballistic information specific to the type of ammunition and makes an adjustment to a point of aim of the firearm based on the ballistic information.

An identification of a weapon is another example shooting condition. An example embodiment determines an identity of a weapon firing the projectile, determines any shooting conditions or weapon information that are particular to the weapon, and alters the point of aim based on this information.

Even two guns of a same make, model, and manufacturer can have different ballistic trajectories of ammunition. By way of example, these differences can result from age of the weapon, burred muzzle, eroded or obstructed or dirty barrel, worn trigger mechanism, differences of mechanical parts and fits due to manufacturing tolerances, etc.

Consider an example in which an electronic scope includes or communicates with a weapon targeting system. When the electronic scope is mounted to a firearm, the electronic scope determines weapon information about the firearm.

For instance, the firearm communicates this weapons information to the electronic scope, or the electronic scope retrieves this information from a server or network based on a unique identification number of the weapon.

Bore temperature is another example shooting condition. An example embodiment determines a bore temperature or barrel temperature of the weapon, uses this temperature to determine a ballistic trajectory for ammunition fired from the weapon, and alters the point of aim based on the bore temperature and/or ballistic trajectory. For example, bore temperature of a rifle barrel affects the trajectory of bullets fired from the rifle even when these bullets are identical. For instance, a warm or hot rifle barrel with a zero range of 150 yards will hit a bullseye at 150 yards. This same rifle, however, with a cold rifle barrel (e.g., a first shot) can shoot a bullet that impacts one to two inches below the bullseye on the target. A first shot fired from a cold weapon or cold bore shot can miss a target even if the weapon is properly sighted to the target.

Point of impact shifts or shifts in impact location due to bore temperature can be recorded and stored for various bore temperatures. Further, bore temperatures can be read or sensed (e.g., with a sensor) or estimated based on a number of shots fired and a time interval between shots. Furthermore, specific point of impact shifts can be interpolated or estimated based on known point of impact shifts for different bore temperatures and target distances.

Consider an example of an M16 rifle that is cold barrel zero sighted at 200 yards. A first or cold shot from the barrel will hit the bullseye at 200 yards. Successive shots, however, heat the barrel and change the bore temperature. This increase in temperature can cause subsequent shots to miss the bullseye at 200 yards at predictable or known locations.

Consider another example of an M16 rifle that is zero sighted at 100 yards with a heated or warm bore (e.g., after the rifle fires several shots). Later, the rifle is taken on a combat mission, and a soldier prepares to fire the weapon for the first time that day. A weapon targeting system determines this first shot is a cold bore shot since the weapon has not been recently fired and the bore is still cold (e.g., ambient temperature). The weapon targeting system automatically adjusts crosshairs on an electronic scope attached to the M16 in order to compensate for the cold bore shot. After the cold bore shot is fired, the weapon targeting system readjusts the crosshairs since the bore is no longer cold.

Ambient conditions are other example shooting conditions. An example embodiment determines one or more environmental conditions in order to calculate or determine ballistic information for ammunition and adjust the point of impact based on this information and/or environmental conditions. These environmental conditions includes, but are not limited to, altitude, wind, outdoor temperature, atmospheric pressure, precipitation, and relative humidity.

For example, ballistic tables for ammunition are based on standard test conditions at a given altitude, outdoor temperature, atmospheric pressure, and relative humidity. Information in ballistic tables changes when one or more of these conditions change. Changes to these conditions are determined in order to calculate or acquire accurate ballistic information for the given environmental condition. For example, a bullet fired in a first environment (altitude=sea level, temperature=59° F., atmospheric pressure=29.5", and relative humidity=78%) will have a very different ballistic trajectory path from the same bullet fired in a second environment (altitude=10,000 feet, temperature=20° F., atmospheric pressure=21", and relative humidity=70%). An example embodiment adjusts the point of aim based on one or more of these differences.

Vapor trail or trace is another example shooting condition. Vapor trail or trace is a visible or discernable disturbance or change of air pressure that a projectile causes as it travels through the air. The vapor trail provides a visual clue or an indication of the trajectory path of the projectile and/or the location of the impact location, point of impact, or miss location since the vapor trail shows or traces the flight path of the projectile.

A shape of the vapor trail also provides an indication as to a direction and speed of wind. For example, a straight or parabolic vapor trail that follows the line of sight indicates little or no cross wind. By contrast, a curved, distorted, disrupted, bent, or bowed vapor trail from the line of sight indicates wind drift in the direction of the curve, distortion, disruption, bend, or bow.

Consider an example in which a weapon targeting system is not able to discern from an image of a target an impact location on the target (e.g., the target is not visually clear or too far away). The vapor trail from the weapon to the target, however, is visible and provides an indication whether the projectile struck the target or missed the target. For instance, if the vapor trail of a bullet veered or curved to a right side of the target, this would indicate that the bullet missed to the right of the target. A leftward adjustment would compensate for this miss. The weapon targeting system captures, stores, and analyzes images or video of the vapor trail to determine a trajectory path of the projectile.

Mirage or heat haze is another example of a shooting condition. Mirage or heat haze exists when convection causes the temperature of air to vary, and this variation creates a gradient in the refractive index of air. This gradient in turn produces a visible or discernable shimmering affect. A shape or pattern of the mirage provides an indication of wind. Further, a bullet or projectile can disrupt or disturb the mirage and provide an indication of the trajectory path of the projectile and/or the location of the impact location or point of impact.

Consider an example in which video or photos reveal right-to-left mirage movement. A scope is dialed one-half (½) minute of angle (MOA) right to counteract this mirage movement for a shot at 700 yards.

Consider an example in which hot air rising from the ground appears as a mirage in the form of wavy water vapor rays emanating from the ground. A weapon targeting system captures successive images of a target and mirage positioned between the weapon and the target. Analysis of these images indicates the water vapor rays moving from left to right from the point of view of the line of sight of the weapon. An amount of this movement correlates to a crosswind that blows from the left to the right. An angle of the water vapor rays or an amount of disturbance of these rays is correlated with a mirage table to determine a wind compensation for the point of aim of the weapon.

Shot pattern and impact location analysis are other example shooting conditions.

An analysis of shot patterns and impact locations and miss locations provide information as to shooter or weapon tendencies to hit or miss a bullseye location. A probability or likelihood of hitting or missing a bullseye location can be calculated and assigned to a shot based on an analysis of previous or historic shots fired with the weapon, ammunition, shooter, environmental conditions, etc.

Consider an example in which images of impact locations and/or miss locations are provided to a pattern recognizer that determines an X-directional distance and a Y-directional distance to move a point of aim. By way of example, these X and Y directional distances correspond to a minute of angle (MOA) or a fraction of a MOA. For example, these distances are an average offset or average distance from a bullseye location, a desired target impact location, or a point of aim. As yet another example, the pattern recognizer can utilize supervised or unsupervised learning calculations to determine adjustments to the point of aim based on historic impact locations.

Consider an example in which a weapon targeting system stores an image of a target showing a point of aim when a bullet was fired from a firearm, a bullseye location on the target, and the impact location of the bullet on the target. The weapon system compares or analyzes the image with multiple other images that show points of aim when bullets were fired from the firearm, the bullseye location, and multiple other impact locations of the bullets on the target. This comparison or analysis reveals a pattern of the bullets that missed the bullseye location in a certain area or region adjacent the bullseye location. The weapon system calculates a probability that the next shot will also be within this certain area or region. This probability indicates that the next shot has a sixty percent (60%) chance or probability of landing in this area or region. The weapon targeting system moves or adjusts the point of aim to compensate for the bullets that missed the bullseye location.

Consider an example in which a weapon targeting system determines that an electronic scope and firearm are properly sighted or zeroed based on distance to the target, ammunition type, weapon type, and environmental conditions. Nonetheless, thirty percent (30%) of shots fired from the firearm are slightly high and right on the target. The weapon targeting system analyzes previous locations of the points of impact and determines that lowering the point of aim will increase the overall accuracy of the shooter and firearm to hit the target.

An identity of a shooter of the weapon is another example shooting condition. Traditionally, settings to the weapon and sighting device are generic and the same for each shooter. For example, once a scope is sighted or calibrated to a rifle for targets at 100 yards, then settings to the scope and rifle would remain constant or unchanged regardless of who is shooting the rifle at targets at 100 yards.

In an example embodiment, one or more settings to the weapon and/or sighting device are personal or specific to an identity of the shooter firing the weapon. For example, once a scope is sighted or calibrated to a rifle for targets at 100 yards, then one or more settings to the scope and/or rifle would change depending on an identity of the shooter.

Consider an example in which a first shooter has a tendency to miss low on shots from two hundred (200) to three hundred (300) yards, and a second shooter has a tendency to miss right on shots from these distances. The first shooter aims a firearm at a target 250 yards away. A weapon targeting system identifies the first shooter and adjusts the point of aim to compensate for the tendency of the first shooter to miss low. A second shooter aims the same firearm at the target 250 yards away. The weapon targeting system identifies the second shooter and adjusts the point of aim to compensate for the tendency of the second shooter to miss right.

One or more shooting conditions can also be used to verify or validate another shooting condition. For example, shooting conditions verify or determine wind direction and wind speed at a geographical location. A weapon targeting system or electronic sighting device observes, measures, and analyzes movement of objects due to wind to determine a speed and direction of the wind at the geographical location. Movement of trees, leaves, branches, grass, flags, smoke, vapor trails, clothing, foliage, brush, etc. provides information as to the direction and speed of wind. For instance, a camera or recording device captures images or video of this movement, and the weapon targeting system analyzes the movement to determine the wind speed and direction.

Consider an example in which a weapon targeting system communicates with a Doppler weather service to learn the wind at a combat location is 1-2 mph and coming out of the North West. The weapon targeting system uses this information to adjust crosshairs on rifles of soldiers fighting at the combat location. The weapon targeting system monitors and analyzes shots fired at the combat location and determines that the soldiers are uncharacteristically missing the targets. Analysis of vapor trails and movement of tree leaves, grass, and surrounding foliage shows that the wind is not 1-2 mph but actually 6 mph with wind gusts in a valley at the combat location of 9 mph. Furthermore, this analysis shows that the wind is actually emanating from the West, not the North West as previously reported. Based on this information, the weapon targeting system readjusts the crosshairs on the rifles of the soldiers fighting at the combat location.

The weapon targeting system can make various observations to determine shooting conditions. These observations are used to assist in adjusting a point of aim for a weapon.

Consider an example in which a soldier fires a firearm toward a human target and misses. The weapon targeting system attempts to determine a miss location, but an impact location of the bullet cannot be discerned and a vapor trail is not available. Analysis of video of the shot, however, shows the bullet disrupted or moved clothing on a right shoulder of the human target. Based on this information, the weapon targeting system determines a miss location and makes an adjustment to the sighting device and/or provides this miss location to the soldier. For instance, the weapon targeting system displays the miss location to the soldier on a display in the sighting device. Alternatively, the weapon targeting system provides the information to the soldier, such as providing an audible or visual indication that the miss location was at the right shoulder.

Consider an example in which a hunter fires a rifle toward a deer and misses.

The weapon targeting system attempts to determine a miss location, but an impact location of the bullet cannot be discerned. The bullet, however, caused several leaves to move as it missed the deer. Based on this information, the weapon targeting system determines a miss location and displays this miss location to the hunter. The hunter makes a quick sight adjustment, fires again, and hits the deer.

FIG. 5 is a method to adjust an electronic sighting device of a weapon in real time based on a direction and speed of wind and a direction of a point of aim of the weapon.

Block 500 states determine a distance from a weapon with an electronic scope to a target.

By way of example, a distance to a target is determined as discussed in connection with block 110.

Block 510 states determine a direction of wind and a speed of the wind at a location of the weapon and/or the target.

A human and/or one or more electronic devices can determine the direction of the wind and the speed of the wind. For example, instruments to measure wind speed and/or direction include, but are not limited to a wind sensor, a wind vane, an anemometer, a weather map, a compass, a weather satellite, etc. Further, real-time information about wind direction and wind speed can be obtained from a database, the Internet, weather stations, GPS location, human observation and estimation or measurement, etc.

Consider an example in which an electronic device mounted on or included with a weapon or sighting device communicates with a network and a server to obtain current weather and location information based on a longitude and latitude location of the weapon or a global positioning system (GPS) location. The weapon, sighting device, or weapon targeting system receives this information (such as current outdoor temperature, wind speed, wind direction, and altitude) and uses this information to determine adjustments to the point of aim.

Consider an example in which a shooter provides a weapon or HPED in communication with the weapon with current weather and location information that include wind direction and wind speed. This information assists in adjusting the point of aim.

Consider an example in which a weapon targeting system includes a software program the communicates with a weather satellite, a Doppler radar service, a weather database, or a weather website to obtain real time weather information that includes wind direction and wind speed for a specific geographical location or GPS location. A weapon targeting system receives this information.

Block 520 states determine a direction of a point of aim of the weapon with respect to the direction of the wind and the speed of the wind.

A human and/or one or more electronic devices can determine the direction of the point of aim of the weapon and/or the direction of the point of aim of the weapon with respect to the direction of the wind and/or the speed of the wind. For example, instruments to measure the direction of the point of aim of the weapon include, but are not limited to, a compass, a magnetometer, a heading indicator, an inclinometer, a gyroscope, an accelerometer, a sensor, or other electrical device to determine direction.

Block 530 states determine an adjustment to a ballistic trajectory of a projectile fired from the weapon based on the distance to the target, the direction of the wind, the speed of the wind, and the direction of the point of aim of the weapon with respect to the direction of the wind and the speed of the wind.

The adjustment to the ballistic trajectory of the projectile fired from the weapon depends on the distance to the target, the direction of the wind, the speed of the wind, and the direction of the point of aim of the weapon with respect to the direction of the wind and the speed of the wind. This adjustment can be calculated in real time or retrieved from a database or memory. For instance, ballistic trajectory tables and wind drift tables for a given weapon and ammunition include adjustments for wind affects based on distance to a target, wind speed, and relative wind direction to the point of aim of the weapon.

The affects of wind on the trajectory path of the projectile can be mathematically calculated. By way of example, the direction of the wind is made with respect to a frame of reference or reference direction, such as horizontal axis, vertical axis, X-axis, Y-axis, etc. The wind is viewed as a vector, and an identification or calculation is made of the angle the vector makes with the reference direction. Next, an identification or calculation is made of the magnitude of the vector. Next, the two components of the vector are calculated using a geometric formula of the following:

$$\text{Vector Component 1}=(\text{magnitude})\times\sin(\text{angle}),$$

$$\text{Vector Component 2}=(\text{magnitude})\times\cos(\text{angle}).$$

Consider an example in which a shooter aims a gun into a 5 mph wind such that the wind impacts the rifle at a thirty-seven degree (37°) angle. The vertical component of the wind or headwind component and the horizontal component or drift component of the wind are as follows:

$$\text{Vertical Component}=(5\text{ mph})\times\sin)(37°=3\text{ mph, and}$$

$$\text{Horizontal Component}=(5\text{ mph})\times\cos)(37°=4\text{ mph.}$$

The two components of the wind vector can be applied to ballistic and wind drift tables to determine the vertical affect (i.e., slowing down of the bullet resulting in vertical bullet drop) and the horizontal affect (i.e., drift of the bullet from the line of sight at the target). For instance, a vertical drop table provides the vertical drop, and wind drift table provides the horizontal drift.

Block 540 states adjust the point of aim of the weapon based on the adjustment to the ballistic trajectory.

The point of aim is adjusted to compensate for or offset the affects of the wind on the trajectory path of the projectile from the weapon to the target. By way of example, this adjustment and application of this adjustment to the point of aim can occur continuously, continually, periodically, in response to a change in wind speed, in response to a change in wind direction, in response to a change in distance to the target, and/or in response to a change in the direction of the point of aim of the weapon.

Consider an example in which a rifle with an electronic scope is sighted or zeroed for targets at 100 yards and no wind. A hunter prepares to fire the rifle at a first deer that is 150 yards away directly into a 10 mph headwind. A weapon targeting system calculates affects of the wind and the difference in yardage (i.e., plus 50 yards from previous sighted or zeroed distance) and adjusts, based on these calculations, a location of the crosshairs in the electronic scope mounted to the rifle. With these adjustments, the crosshairs now show the correct point of aim so a shot fired from the rifle will strike the first deer at the location of the crosshairs. Before firing the rifle, the hunter notices a second deer located in a different direction and moves the rifle and crosshairs onto this second deer. This second deer is located 300 yards away with a line of sight of the rifle pointed into the wind at a forty-five degree (45°) angle with respect to the direction of the wind. The weapon targeting system calculates affects of the wind and the difference in yardage (i.e., plus 200 yards from previous sighted or zeroed distance) and adjusts, based on these calculations, a location of the crosshairs in the electronic scope mounted to the rifle. With these adjustments, the crosshairs now show the correct point of aim so a shot fired from the rifle will strike the second deer at the location of the crosshairs.

Consider an example in which a soldier wears a wearable electronic device (WED) that communicates with his rifle to show a point of aim of the rifle on the WED. This point of aim includes a red dot that appears on a display of the WED. The red dot follows, tracks, and shows in real time where the rifle is aimed. The soldier engages numerous enemy combatants that are scattered at different positions along a windy mountain range. As the soldier moves his rifle to aim and/or fire on different enemy combatants, a weapon targeting system readjusts or recalculates an adjustment to the point of aim of the rifle for each of these different enemy combatants. These readjustments or recalculations occur because each enemy combatant has a different distance, wind direction, and wind speed with respect to the soldier.

Consider an example in which a rifle has a zero range of 200 yards with no wind. A shooter aims the rifle at a target 200 yards away with a cross-wind or right angle wind of 10 mph with respect to the line of sight of the rifle. In addition to the wind speed and direction, other information is known, such as one or more of the bullet weight, muzzle velocity, barometric pressure, ballistic coefficient, outdoor temperature, and relative humidity. With this information, a weapon targeting system calculates a horizontal wind drift of 2.13 inches and moves a point of aim on a display of an electronic scope in order to offset or compensate for this wind drift.

Figure 6A:
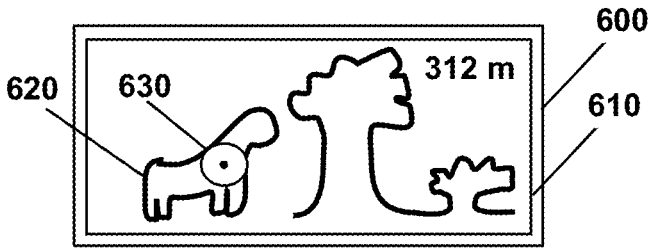
FIG. 6A is an electronic device and display with a point of aim on a target before a shot is fired at the target in accordance with an example embodiment.
Figure 6B:
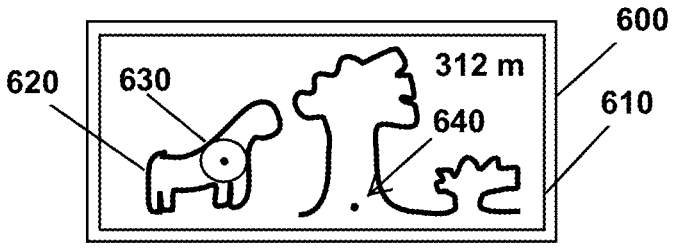
FIG. 6B is the electronic device and display with the point of aim on the target after the shot is fired at the target in accordance with an example embodiment.
Figure 6C:
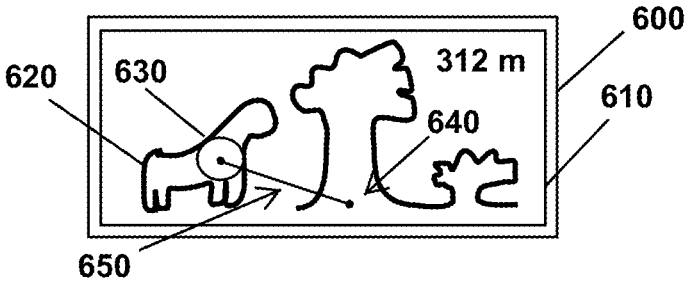
FIG. 6C shows a weapon targeting system calculating a distance between the point of aim and an impact location in accordance with an example embodiment.

FIGS. 6A-6C show an electronic device 600 with a display 610 that includes a weapon targeting system. The display 610 displays a target 620 with a point of aim 630 of a weapon positioned on the target at a distance of three hundred and twelve (312) meters (m).

FIG. 6A shows the point of aim 630 positioned on target 620 before a shot is fired at the target. A black dot in the middle of the point of aim 630 indicates where the weapon is aimed when a shot is fired.

FIG. 6B shows the point of aim positioned on the target 620 after the shot is fired at the target. The shot misses the target and impacts a tree at impact location 640. Since the impact location 640 does not coincide with the point of aim 630 then the weapon is not sighted with an aiming device (e.g., an electronic scope or other electronic device) and/or a shooting condition is causing the shot fired from the weapon to miss the point of aim.

FIG. 6C shows the weapon targeting system calculating a distance and direction 650 between the point of aim 630 and the impact location 640. The weapon targeting system uses this distance and direction to adjust the point of aim so an impact location of a shot fired from the weapon coincides with the point of aim.

By way of example, the weapon targeting system uses a rangefinder to determine a first straight line distance to the target at the point of aim, to determine a second straight line distance to the impact location, and to determine an angle between the first and second straight lines. The weapon targeting system calculates the distance based on knowing the first straight line distance, the second straight line distance, and the angle between these two lines.

Figure 7A:
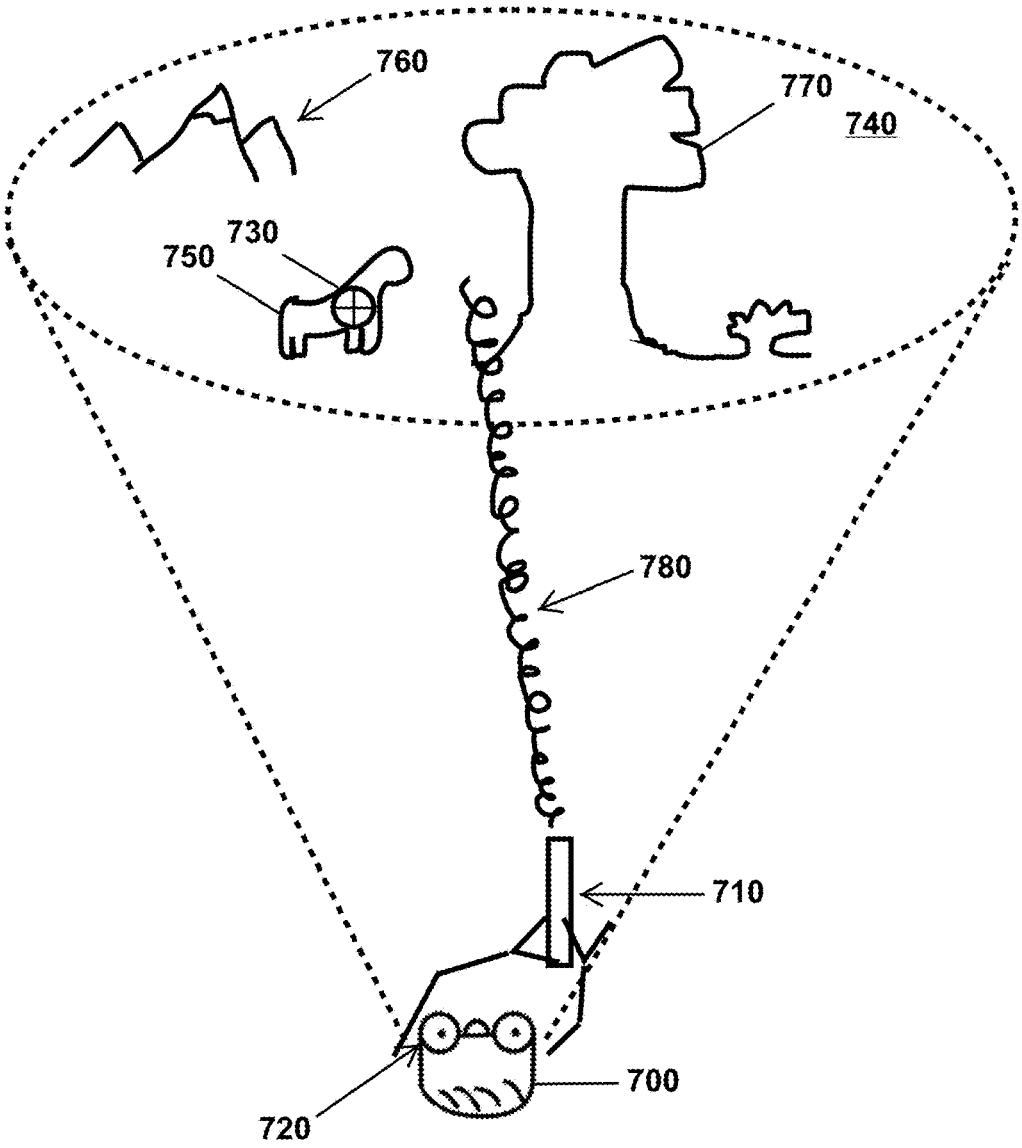
FIG. 7A shows a weapon targeting system that determines a miss location when a shooter fires a bullet from a firearm in accordance with an example embodiment.

FIG. 7A shows a weapon targeting system that determines a miss location when a shooter 700 fires a bullet from a firearm 710. The shooter wears wearable electronic glasses (WEG) 720 that display a point of aim 730 in a field of view 740 that includes a target 750, mountains 760, and a tree 770 next to the target 750.

When the point of aim 730 aligns on the target 750, the shooter 700 fires the firearm 710, but the bullet misses the target 750. The bullet does not strike a visible target or does not leave a visible impact location on an object. The weapon targeting system analyzes images or video of a vapor trail 780 to determine a miss location of the bullet.

Figure 7B:
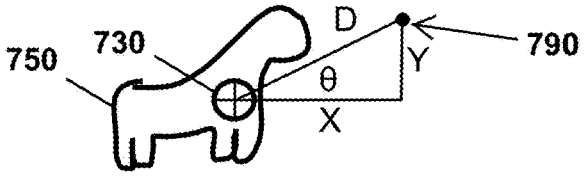
FIG. 7B shows the weapon targeting system calculating a miss location for the bullet in accordance with an example embodiment.

FIG. 7B shows the weapon targeting system calculating a miss location 790 for the bullet. Analysis of the vapor trail shows that it passed next to the target 750 at the miss location 790 (shown as being high and to the right of the point of aim 730 from the point of view of the shooter). Further, based on this analysis, the weapon targeting system calculates one or more of a horizontal distance X from the point of aim 730 to the miss location 790, a vertical distance Y from the point of aim 730 to the miss location 790, and an angle θ to the miss location 790. The weapon targeting system calculates a distance D between the point of aim 730 and the miss location 790 and uses this information to calculate an adjustment to the point of aim so it corresponds with impact locations of subsequent bullets fired from the firearm.

The vapor trail shows a trajectory path of a projectile fired from the weapon and assists the weapon targeting system or electronic sighting device in determining the trajectory path and an impact location or a miss location. For example, in some situations, it may be difficult to determine an impact location or a miss location (e.g., when the impact location is a far distance from the user, when the weapon is not pointed at an object or pointed into air or space, when the impact location is not in the field of view of the user, etc.). In these instances, the vapor trail path shows where the weapon was pointed and also shows the flight path of the projectile even though the user may not be able to see the actual impact location.

Figure 8A:
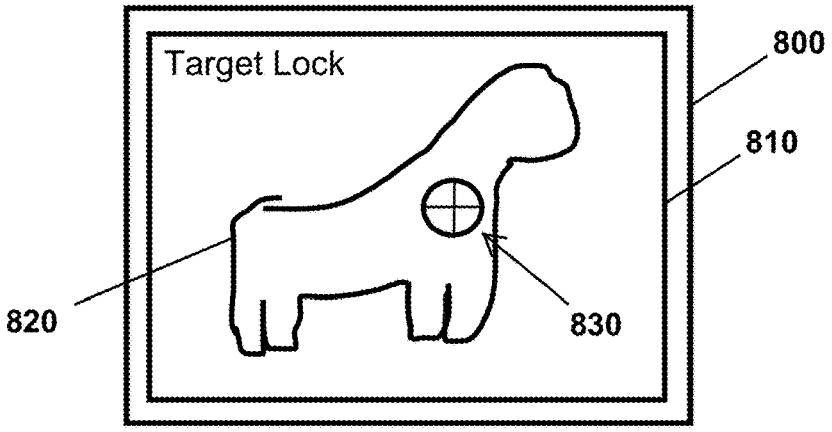
FIG. 8A shows an electronic device and display with a point of aim positioned on a target in accordance with an example embodiment.
Figure 8B:
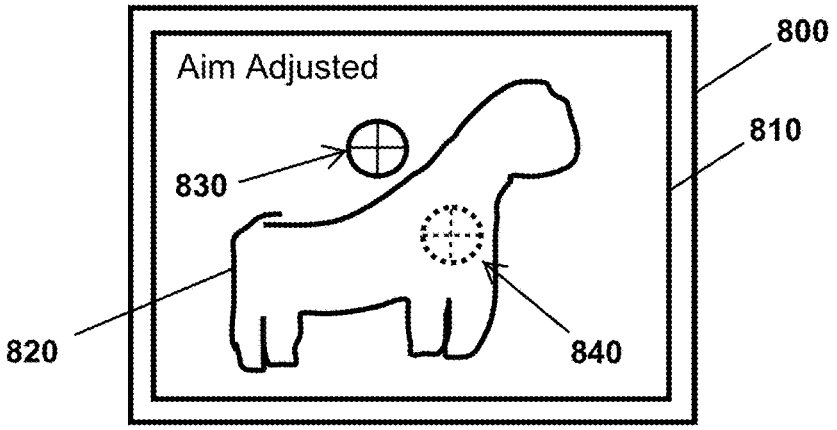
FIG. 8B shows the point of aim moved or adjusted to a new location from an old location in accordance with an example embodiment.
Figure 8C:
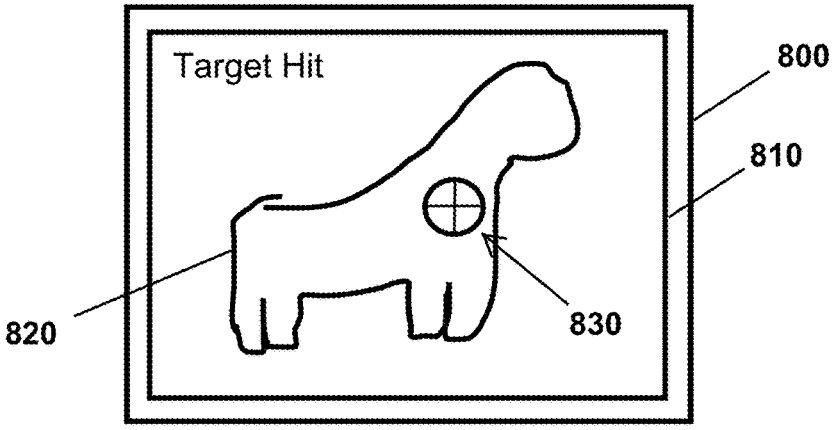
FIG. 8C shows the point of aim positioned back on the target in accordance with an example embodiment.

FIGS. 8A-8C show an electronic device 800 with a display 810 that includes a target 820 and a point of aim 830 of a weapon.

FIG. 8A shows the point of aim 830 positioned on the target 820. The display 810 displays "Target Lock" to indicate to a shooter that the electronic device 800 identifies and/or recognizes the target 820 as being the intended object at which the weapon will fire.

FIG. 8B shows the point of aim 830 being moved or adjusted to a new location from an old location (the old location being shown at 840 with dashed lines on the target 820). The display 810 displays "Aim Adjusted" to indicate to the shooter that the electronic device 800 moved or adjusted a location of the point of aim 830.

FIG. 8C shows the point of aim 830 positioned back on the target 820. The display 810 displays "Target Hit" to indicate to the shooter that the projectile fired from the weapon hit the target at the point of aim 830.

Consider an example in which a shooter aims a firearm on the target 820 as shown in FIG. 8A. An electronic scope 800 displays a point of aim 830 of the firearm. The firearm and electronic scope were previously sighted or zeroed for targets at 500 yards, but the present target 820 is 200 yards from the firearm. As shown in FIG. 8B, the electronic scope 800 moves the point of aim 830 to compensate for this difference in distance and for a crosswind with respect to a line of sight of the firearm. This movement includes moving the point of aim 830 being displayed on display 810 from a first location on the target 820 to a second location off of the target 820 as shown in FIG. 8B. At this point in time, the point of aim 830 is no longer positioned on the target 820 even though the shooter has not yet moved the firearm. In response to movement of the point of aim 830 off of the target, the shooter physically moves the firearm to re-align the point of aim 830 onto the target and fires the weapon as shown in FIG. 8C. A bullet fired from the weapon hits the target 820 at the point of aim 830 and the display 810 of the electronic scope 800 displays "Target Hit" as shown in FIG. 8C.

Figure 9A:
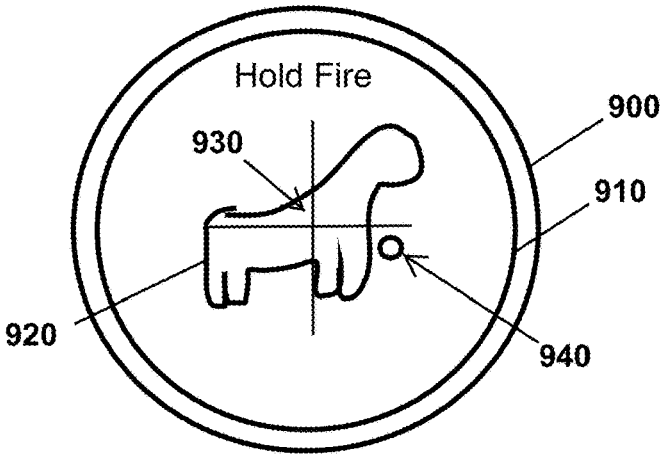
FIG. 9A shows an electronic device and display that shows a point of aim positioned on a target in accordance with an example embodiment.
Figure 9B:
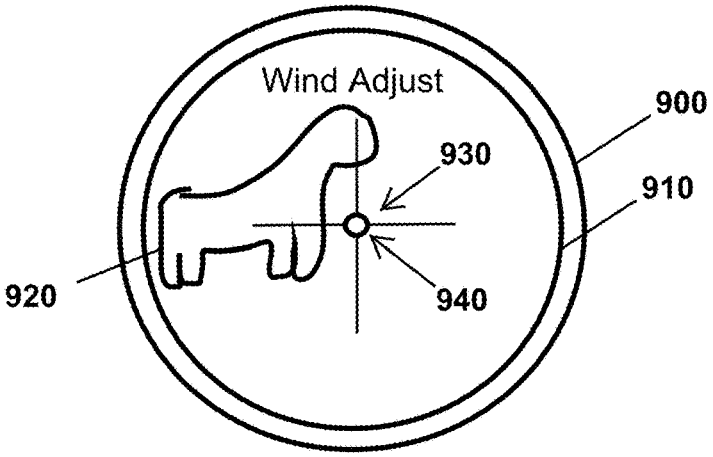
FIG. 9B shows the point of aim moved or adjusted to a new location that coincides with the impact location in accordance with an example embodiment.
Figure 9C:
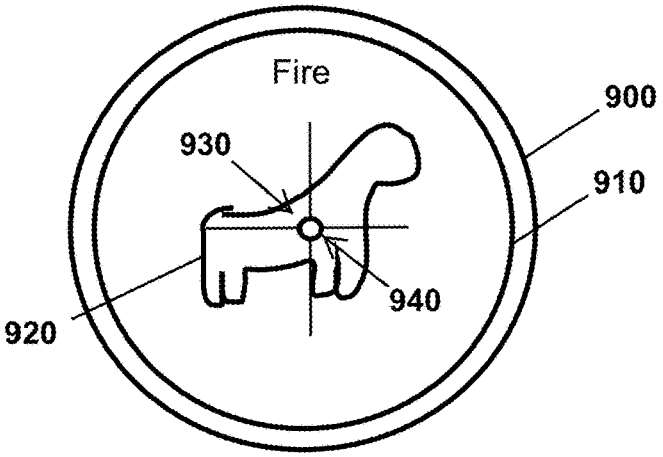
FIG. 9C shows the point of aim positioned back on the target in accordance with an example embodiment.

FIGS. 9A-9C show an electronic device 900 with a display 910 that includes a target 920, a point of aim 930 of a weapon, and an impact location 940 of where a projectile will hit when the weapon is fired.

FIG. 9A shows the point of aim 930 positioned on the target 920. The display 910 displays "Hold Fire" to indicate that a shooter should not fire the weapon at this moment. The impact location 940 of a projectile fired from the weapon at this moment will not hit the target 920 at the point of aim 930 (e.g., not at a center of the crosshairs).

FIG. 9B shows the point of aim 930 being moved or adjusted to a new location that coincides with the impact location 940. The display 910 displays "Wind Adjust" to indicate to the shooter that the electronic device 900 moved or adjusted a location of the point of aim 930 to adjust for wind. Without this adjustment, the wind will affect the projectile fired from the weapon and cause the projectile to miss the target 920 and hit the impact location 940 that is not on the target.

FIG. 9C shows the point of aim 930 positioned back on the target 920. The display 910 displays "Fire" to indicate to the shooter that a projectile fired from the weapon will hit the target at the point of aim 930 and impact location 940.

Consider an example in which a shooter aims a firearm on the target 920 as shown in FIG. 9A. An electronic scope 900 displays a point of aim 930 of the firearm. The firearm and electronic scope were previously sighted or zeroed for targets at 100 yards with no wind, but the present target 920 is 150 yards from the firearm with an 8 mph crosswind. If the shooter shot the firearm, then the bullet would miss the target 930 at the impact location 940 (i.e., the bullet would be low due to the added 50 yards and off right due to the crosswind). FIG. 9A shows the weapon and electronic scope 900 are not sighted or zeroed for 150 yards and further without an adjustment for an 8 mph crosswind. As shown in FIG. 9B, the electronic scope 900 moves the point of aim 930 to compensate for this difference in distance and for this crosswind with respect to a line of sight of the firearm. This movement includes moving or shifting the image or view that is presented on the display 910. Here, the point of aim 930 remains centered on the display 910, but the target 920 moves or adjusts to compensate for the additional yardage and wind. FIG. 9B shows a view with the weapon and the electronic scope 900 being sighted for 150 yards and adjusted for an 8 mph crosswind. At this point in time, the point of aim 930 is no longer positioned on the target 920 even though the shooter has not yet moved the firearm. In response to movement of the point of aim 930 off of the target, the shooter physically moves the firearm to re-align the point of aim 930 onto the target and fires the weapon as shown in FIG. 9C. A bullet fired from the weapon at this moment will hit the target 920 at the point of aim 930 and at the impact location 940. The display 910 of the electronic scope 900 displays "Fire" as shown in FIG. 9C to instruct the shooter to fire or to indicate that the weapon is automatically firing the weapon for the shooter.

FIGS. 10A-10D show an electronic device 1000 with a display 1010 that includes a target 1020 and a point of aim 1030 of a weapon.

Figure 10A:
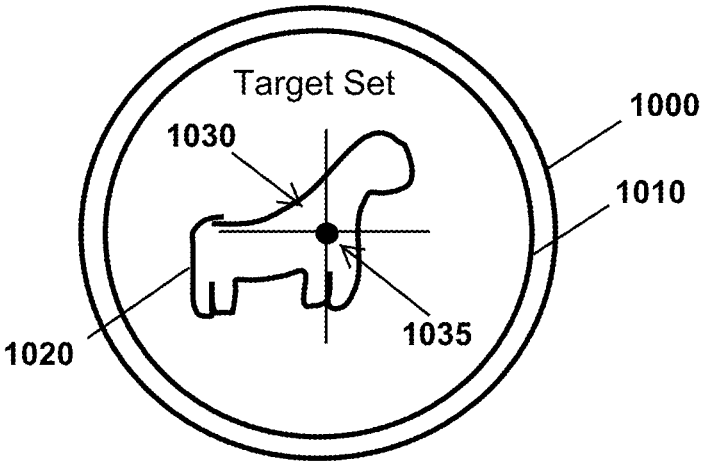
FIG. 10A shows an electronic device and display with a point of aim positioned on a target in accordance with an example embodiment.

FIG. 10A shows the point of aim 1030 positioned on the target 1020. The display 1010 displays "Target Set" to indicate to the shooter that the target 1020 is identified, tracked, and/or set. The point of aim 1030 is positioned on a desired target impact location 1035. For example, the shooter, the weapon targeting system, the sighting device, or another electronic device sets the desired target impact location 1035 on the target. The shooter should not fire the weapon at this moment since the point of aim is not yet adjusted for the selected target.

Figure 10B:
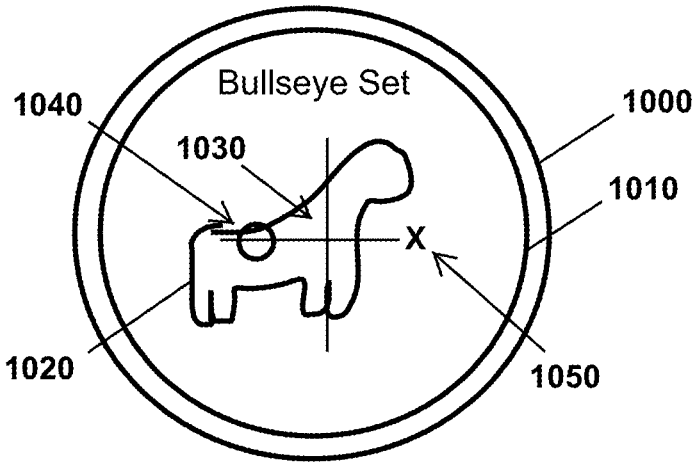
FIG. 10B shows the point of aim moved or adjusted with the addition of a bullseye location in accordance with an example embodiment.

FIG. 10B shows the point of aim 1030 being moved or adjusted with the addition of a bullseye location 1040. The bullseye location 1040 shows the shooter where to move or adjust the point of aim 1030 in order to strike the target 1020. If the shooter were to fire the weapon at this moment, then a projectile fired from the weapon would miss the target at an impact location 1050 shown to the right of the target with an X. The bullseye location 1040 shows the shooter an amount and a direction of how much to adjust or move the weapon and/or point of aim of the weapon. The display 1010 displays "Bullseye Set" to indicate to the shooter to move the weapon and point of aim to align with bullseye location on the target. Without this adjustment, a shooting condition would affect the projectile fired from the weapon and cause the projectile to miss the target 1020 and hit the impact location 1040 that is not on the target.

Figure 10C:
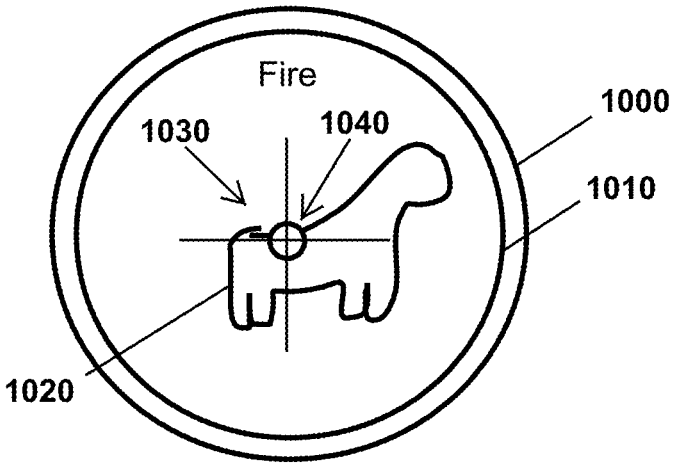
FIG. 10C shows the weapon and/or point of aim moved onto the bullseye location in accordance with an example embodiment.

FIG. 10C shows the weapon and/or point of aim 1030 moved onto the bullseye location 1040. The display 1010 displays "Fire" to indicate that the shooter should fire the weapon.

Figure 10D:
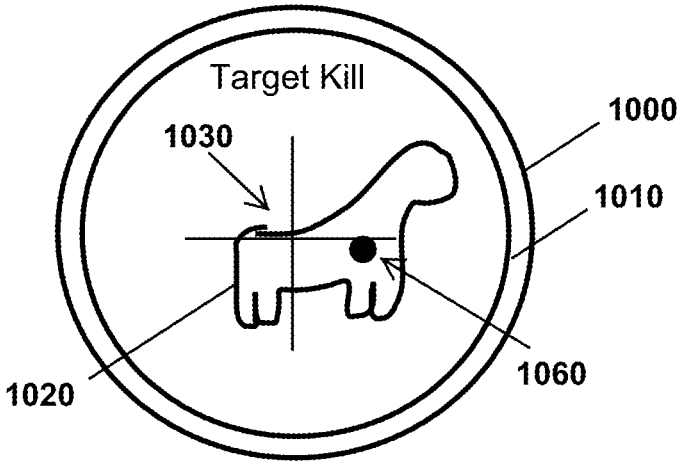
FIG. 10D shows the weapon was fired, and the target was hit at an impact location in accordance with an example embodiment.

FIG. 10D shows the weapon was fired, and the target 1020 was hit at an impact location 1060. The display 1010 displays "Target Killed" to indicate that the target was hit and killed with the shot fired from the weapon.

Consider an example in which a shooter aims a firearm on the target 1020 as shown in FIG. 10A. An electronic scope 1000 displays a point of aim 1030 of the firearm, and the shooter and/or the electronic scope sets this location as the desired target impact location (DTIL) on the target. The firearm and electronic scope were previously sighted or zeroed for target with no wind, but a 10 mph crosswind presently exists. If the shooter shot the firearm, then the bullet would miss the target 1030 at the impact location 1050 (i.e., the bullet would be off right due to the crosswind). FIG. 10B shows the weapon and electronic scope 1000 are not sighted or zeroed without an adjustment for the 10 mph crosswind. As shown in FIG. 10B, the electronic scope 1000 moves the point of aim 1030 by providing a visual indication of the bullseye location 1040. This bullseye location indicates a distance and a direction for how much to move the weapon and/or point of aim to compensate for this crosswind. Here, the point of aim 1030 remains centered on the display 1010, but the bullseye location 1040 visually indicates to move or adjust the weapon and/or point of aim to compensate for the wind. FIG. 10C shows a view after the shooter moved the weapon and/or point of aim to coincide with or align with the bullseye location 1040. At this point in time, the point of aim 1030 does not show where the point of impact will be, but shows the shooter where to fire to hit the desired point of impact 1035. The shooter physically moves the firearm to align the point of aim 1030 onto the bullseye location 1040 and fires the weapon as shown in FIG. 10C. A bullet fired from the weapon at this moment will hit the target 1020 at the desired target impact location 1035. FIG. 10D shows the actual impact location 1060 corresponds with or aligns with the desired target impact location shown in FIG. 10A. The display 1010 of the electronic scope 1000 displays "Target Killed" as shown in FIG. 10D to instruct the shooter that the shot fired hit the target at the impact location 1060 and killed the target.

An example embodiment displays a bullseye location or a desired target impact location (DTIL) on a target. For example, a weapon targeting system identifies an object as a target and determines a bullseye location or a DTIL on the object based on the identification of the object. When the point of aim touches or moves onto or near the bullseye location or DTIL, an audible alarms sounds and/or a visual alarm is provided. At this moment, the weapon can automatically fire such that the audible and/or visible alarm indicates to a shooter that the weapon is about to fire or is firing. Alternatively, the audible and/or visible alarm indicates to the shooter that the shooter should fire the weapon.

Consider an example in which an M16 rifle includes an electronic scope with a weapon targeting system. Crosshairs in the scope show a shooter a point of aim for the rifle. A soldier attempts to aim the rifle at a moving target, but aiming and firing the weapon on this target are difficult since the target is moving. The soldier can only keep the crosshairs on the target for a split second before they jump off the target. The weapon targeting system transitions to an auto fire mode in which the rifle automatically fires when the crosshairs touch or overlap on the target or touch or overlap on a DTIL on the target. This mode facilitates a successful shot on the target since the soldier now merely has to pass the crosshairs onto or over the target for the weapon to fire. Each time the crosshairs pass over the target, the weapon fires. A visual alarm and/or an audible alarm provide the soldier with notification that the rifle fired or is about to fire.

Figure 11A:
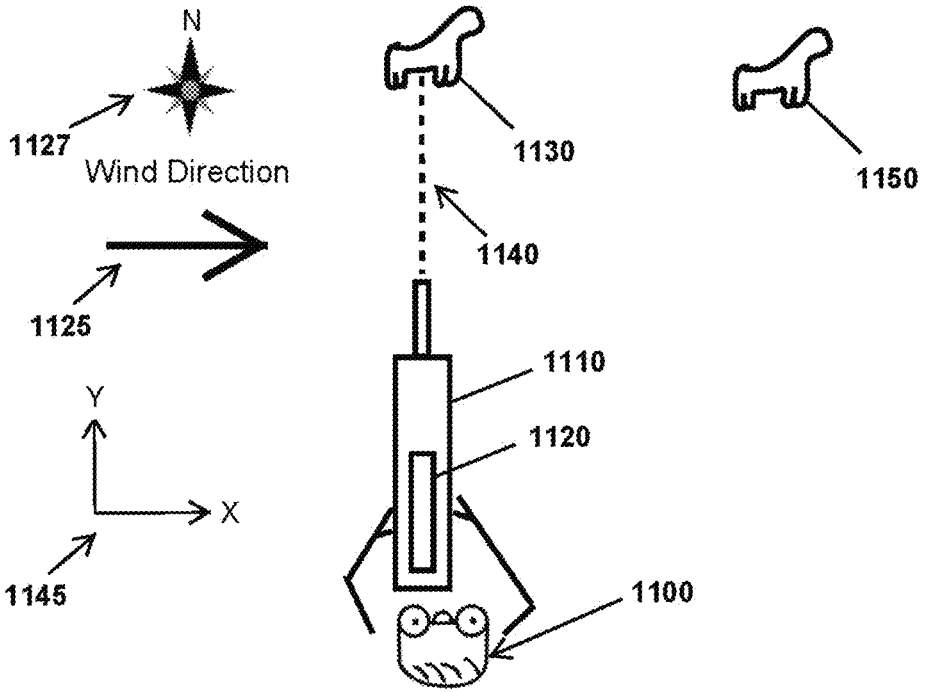
FIG. 11A shows a shooter firing a weapon at a target in a wind in accordance with an example embodiment.
Figure 11B:
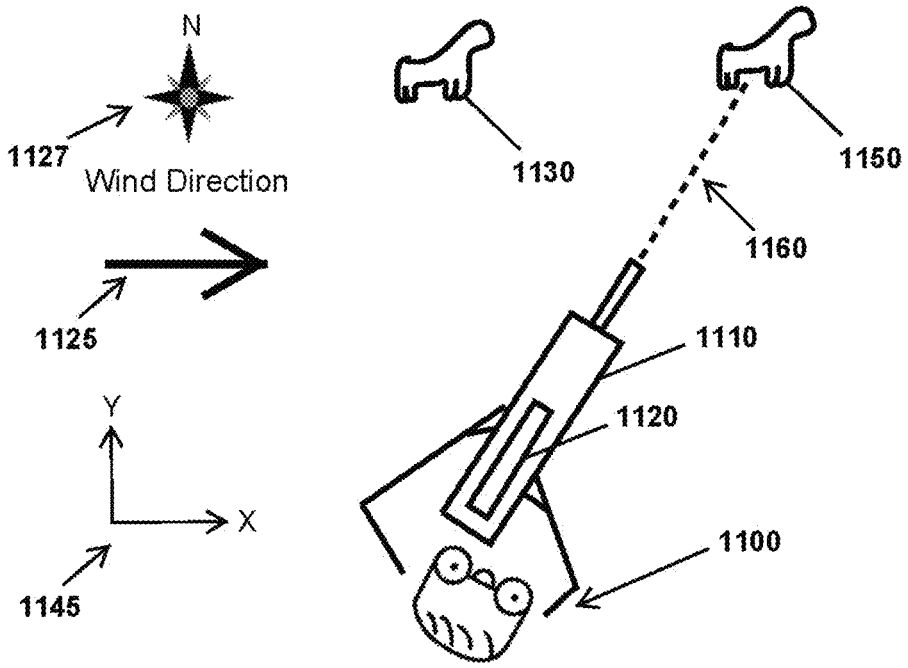
FIG. 11B shows the shooter firing the weapon at another target in the wind in accordance with an example embodiment.

FIGS. 11A and 11B show a shooter 1100 firing a weapon 1110 with an electronic sighting device 1120 with a wind 1125 coming out of the West per compass 1127.

As shown in FIG. 11A, when the shooter aims the weapon 1110 at target 1130, a line of sight 1140 of the weapon 1110 is perpendicular to the direction of the wind 1135. The electronic sighting device 1120 determines a distance to the target 1130, a direction of aim of the weapon 1110 (the direction being North per compass 1127), and a direction and speed of the wind. Based on this information, the electronic scope calculates wind drift or the effects of the wind 1135 on a trajectory path of a projectile fired from weapon and adjusts or moves the point of aim to compensate for the wind drift. Relative to an X-Y coordinate system 1145, the wind 1135 will impact a trajectory path of the projectile at a ninety-degree (90°) angle (i.e., the crosswind is perpendicular to the trajectory path).

An example embodiment can adjust or move the point of aim in real time in response to changes to the wind speed, to the wind direction, and to the direction of the line of sight or the point of aim. For example, the point of aim is adjusted contemporaneously as the shooter moves the weapon with respect to a direction of the wind.

FIG. 11B shows the shooter 1100 moved the weapon 1110 from being aimed on target 1130 to being aimed on target 1150. Here, the weapon 1110 is no longer perpendicular to the direction of the wind 1135 but has a line of sight 1160 at an angle with respect to the direction of the wind 1135. The electronic sighting device 1120 determines a distance to the target 1150, a direction of aim of the weapon 1110 (the direction being Northeast per compass 1127), and a direction and speed of the wind. Based on this information, the electronic scope calculates wind drift or the effects of the wind 1135 on a trajectory path of a projectile fired from weapon and adjusts or moves the point of aim to compensate for the wind drift. Relative to the X-Y coordinate system 1145, the wind 1135 will impact a trajectory path of the projectile at a one hundred and thirty-five degree (135°) angle.

Figure 12A:
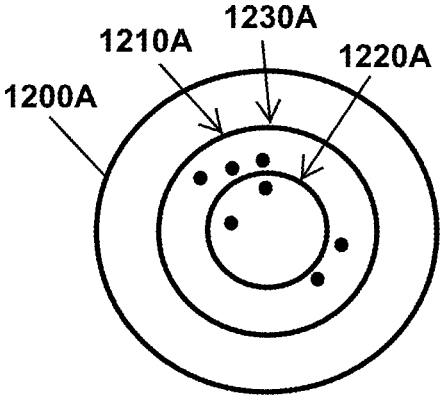
FIG. 12A shows a target with a plurality of impact locations on the target before an adjustment is made to a point of aim of a weapon firing onto the target in accordance with an example embodiment.

FIG. 12A shows a target 1200A with a plurality of impact locations 1210A on the target before an adjustment is made to a point of aim of a weapon firing onto the target. Two of the impact locations are in a center or bullseye location 1220A, and four of the impact locations are in an area 1230A adjacent the bullseye location.

An example embodiment examines the impact locations and determines an adjustment to the point of aim based on a pattern or location of these impact locations. This adjustment will increase an accuracy of impact locations on the target.

Figure 12B:
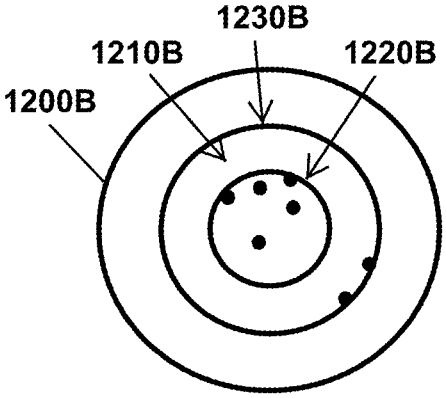
FIG. 12B shows the target with the plurality of impact locations on the target after the adjustment is made to the point of aim of the weapon firing onto the target in accordance with an example embodiment.

FIG. 12B shows a target 1200B with a plurality of impact locations 1210B on the target after an adjustment is made to the point of aim of the weapon firing onto the target. Five of the impact locations are in a center or bullseye location 1220B, and two of the impact locations are in an area 1230B adjacent the bullseye location.

FIGS. 12A and 12B show that an adjustment to the point of aim based on a shooting pattern can significantly increase accuracy of impact locations on a target. In FIG. 12A, only two impact locations are on the bullseye location 1220A, whereas five impact locations are on the bullseye location 1220B in FIG. 12B.

Consider an example in which a shooter fires seven shots with a rifle at a target that is 100 yards away. These shots form the impact locations 1210A shown in FIG. 12A. As shown in the figure, two shots land in the bullseye location 1220A. Now, consider a scenario in which an adjustment was made to the point of aim of the rifle before the shooter shot the seven shots. For example, a scope connected to the rifle was adjusted 2 minutes of angle (MOA) to the right and 1.5 MOA down from a point of view of the shooter facing and aiming at the target. These adjustments would effectively move each of the impact locations shown in FIG. 12A approximately 2.0 inches to the right and 1.5 inches down. FIG. 12B shows the impact locations 1210B that would occur with these adjustments prior to the shooter firing the seven shots. Here, five shots land in the bullseye location 1220B (as opposed to two shots in FIG. 12A).

Figure 13:
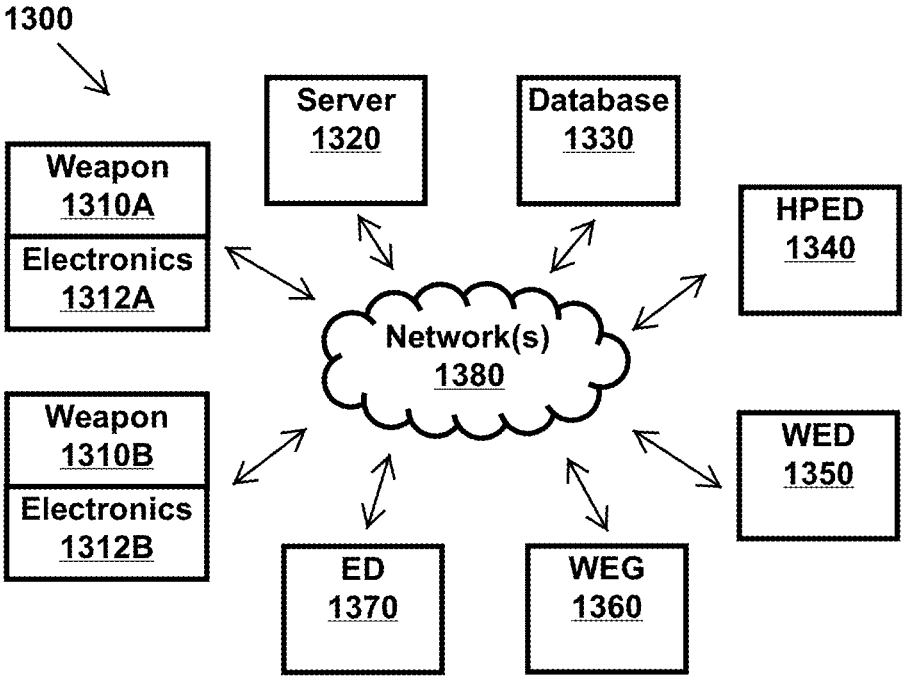
FIG. 13 is a weapon targeting system in accordance with an example embodiment.

FIG. 13 is a weapon targeting system 1300 that includes one or more of the following: weapons 1310A and 1310B including or in communication with an electronic sighting device or electronic device or electronics 1312A and 1312B, a server 1320, a database 1330 or other storage, a handheld portable electronic device or HPED 1340, a wearable electronic device or WED 1350, wearable electronic glasses or WEG 1360, an electronic device 1370 (such as a computer, an electronic scope, camera, a weapon, an arrow, a projectile, or other electronic device), and one or more networks 1380 through which electronic devices can communicate (such as wirelessly communicate).

Figure 14:
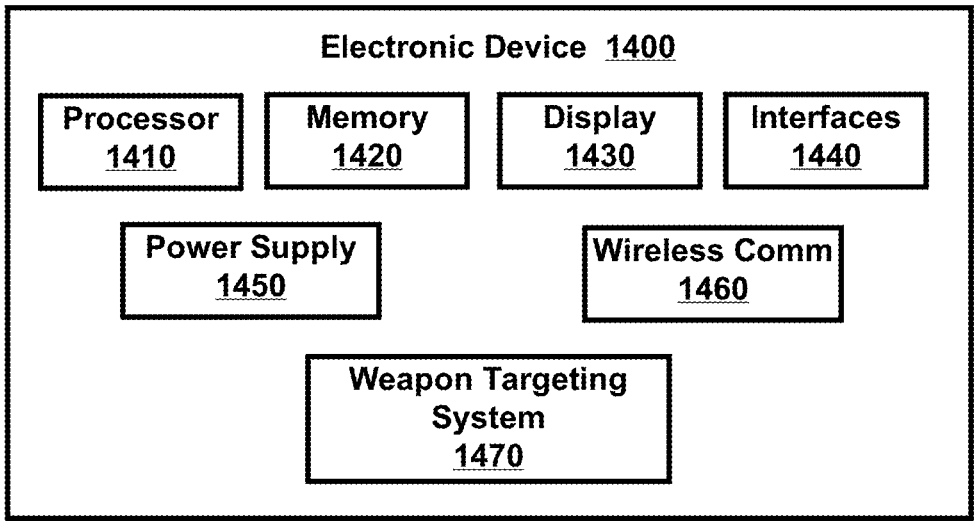
FIG. 14 is an electronic device in accordance with an example embodiment.

FIG. 14 is an electronic device 1400 that includes one or more of the following: a processing unit or processor 1410, a computer readable medium (CRM) or memory 1420, a display 1430, one or more interfaces 1440 (such as a network interface, a graphical user interface, a natural language user interface, and/or an interface that combines reality and virtuality), a battery or a power supply 1450, wireless communication 1460, and a weapon targeting system 1470 (such as a system that executes one or more example embodiments discussed herein).

Figure 15:
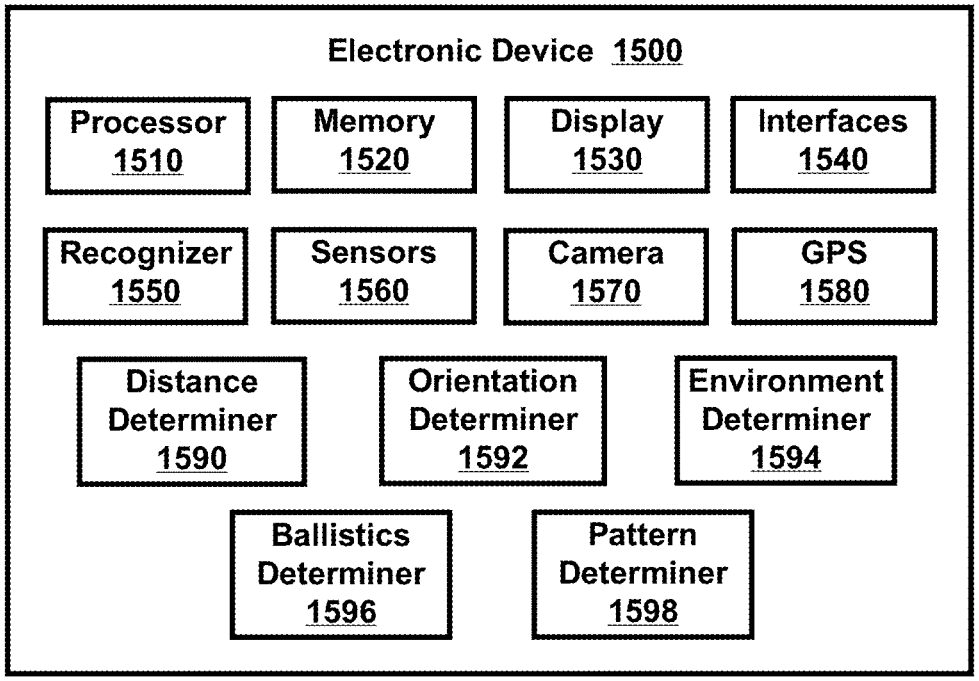
FIG. 15 is another electronic device in accordance with an example embodiment.

FIG. 15 is an electronic device 1500 that includes one or more of the following: a processing unit or processor 1510, a computer readable medium (CRM) or memory 1520, a display 1530, one or more interfaces 1540 (such as a network interface, a graphical user interface, a natural language user interface, and/or an interface that combines reality and virtuality), one or more recognizers 1550 (such as object recognition software, facial recognition software, and/or animal recognition software), one or more sensors 1560 (such as micro-electro-mechanical systems sensor, a motion sensor, an optical sensor, radio-frequency identification sensor, a global positioning satellite sensor, a solid state compass, gyroscope, an accelerometer, a draw length sensor for a string on a bow, and/or a weather sensor), a camera 1570, a global positioning system or GPS 1580, a distance determiner 1590 (such as a laser, an electromagnetic wave transmitter/receiver, a rangefinder, a camera, and/or a camera), a directional determiner or an orientation determiner 1592 (such as a compass, a magnetometer, a heading indicator, an inclinometer, a gyroscope, an accelerometer, a sensor, or other electrical device to determine direction), an environmental determiner 1594 (such as a thermometer, a barometer, a humidity sensor, a wind vane, an anemometer, a compass, and/or software to obtain weather or environmental conditions data), a ballistics determiner 1596 (such as a ballistics calculator, trajectory calculator, wind drift calculator, internal ballistics calculator, and/or an external ballistics calculator), and a pattern recognizer or pattern determiner 1598.

FIGS. 14 and 15 show various components in a single electronic device. One or more of these components can be distributed or included in various electronic devices, such as some components being included in an HPED, some components being included in a server, some components being included in storage accessible over the Internet, some components being in wearable electronic devices or an electronic scope or an electronic sighting device or a weapon or a projectile, and some components being in various different electronic devices that are spread across a network, a cloud, and/or a weapon targeting system.

The processing unit or processor (such as a central processing unit, CPU, microprocessor, application-specific integrated circuit (ASIC), etc.) controls the overall operation of memory (such as random access memory (RAM) for temporary data storage, read only memory (ROM) for permanent data storage, and firmware). The processing unit or processor communicates with memory and performs operations and tasks that implement one or more blocks of the flow diagrams discussed herein. The memory, for example, stores applications, data, programs, algorithms (including software to implement or assist in implementing example embodiments) and other data.

One or more aspects of example embodiments can be included with the example embodiments described in United States patent application entitled "Weapon Targeting System" and having Ser. No. 62/046,904, which is incorporated herein by reference.

Blocks and/or methods discussed herein can be executed and/or made by a user, a user agent of a user, a software application, an electronic device, a computer, and/or a computer system.

As used herein, "bullseye location" is a center of a target, a kill location of a living target, or a desired location to hit a target with a projectile fired from a weapon. For example, a bullseye location can be a central or center area of a target. As another example, a bullseye location can be an intended or desired location or area on a target (such as a designated spot or location on an animal, a human, or an object). The bullseye location is not restricted to being designated with a certain type of indicia, visual identification, and/or audio identification.

As used herein, a "desired target impact location" or "DTIL" is a desired location to hit a target with a projectile fired from a weapon.

As used herein, "determine" includes to ascertain, to calculate, to decide, to obtain, to discover, to retrieve, and/or to receive.

As used herein, "drift" is a deviation from a path of flight of a projectile due to rotation or spin of the projectile. Drift can also be applied to affects from wind.

As used herein, "drop" is a distance that a projectile falls from the line of departure to the ballistic trajectory at a given distance.

As used herein, "field of view" or "field of vision" is the extent of the observable world that is seen or captured at a given moment. For example, without mechanical assistance, humans have almost one hundred and eighty (180) degrees of forward-facing field of view with about one hundred and twenty (120) degrees of this field being binocular vision.

As used herein, a "firearm" is a portable gun, such as a rifle or a pistol.

As used herein, "impact location" is a location where a projectile fired from a weapon impacts an object. Impact location is also known as a "point of impact" or POI.

As used herein, the "line of departure" is a straight line that extends from a centerline or an axis of a bore of a gun or along a mounted arrow in a bow.

As used herein, the "line of sight" is a straight line that extends from the scope or other sighting apparatus or weapon to the target.

As used herein, the "line of trajectory" or the "ballistic trajectory" is the line or flight path that a projectile follows while in flight.

As used herein, the "miss location" is a location along a trajectory path of a projectile fired from a weapon where the projectile misses a target.

As used herein, the "point of aim" is a visual indication of an electronic device that shows where a weapon is aimed.

As used herein, a "weapon" includes firearms (such as portable guns), archery (such as bow and arrows), light weapons, heavy weapons, and other weapons that launch, fire, or release a projectile.

As used herein, a "wearable electronic device" is a portable electronic device that is worn on or attached to a person. Examples of such devices include, but are not limited to, electronic watches, electronic necklaces, electronic clothing, head-mounted displays, electronic eyeglasses or eye wear (such as glasses in which an image is projected through, shown on, or reflected off a surface), electronic contact lenses, an eyetap, handheld displays that affix to a hand or wrist or arm, and HPEDs that attach to or affix to a person.

In some example embodiments, the methods illustrated herein and data and instructions associated therewith are stored in respective storage devices, which are implemented as computer-readable and/or machine-readable storage media, physical or tangible media, and/or non-transitory storage media. These storage media include different forms of memory including semiconductor memory devices such as DRAM, or SRAM, Erasable and Programmable Read-Only Memories (EPROMs), Electrically Erasable and Programmable Read-Only Memories (EEPROMs) and flash memories; magnetic disks such as fixed, floppy and removable disks; other magnetic media including tape; optical media such as Compact Disks (CDs) or Digital Versatile Disks (DVDs). Note that the instructions of the software discussed above can be provided on computer-readable or machine-readable storage medium, or alternatively, can be provided on multiple computer-readable or machine-readable storage media distributed in a large system having possibly plural nodes. Such computer-readable or machine-readable medium or media is (are) considered to be part of an article (or article of manufacture). An article or article of manufacture can refer to any manufactured single component or multiple components.

Method blocks discussed herein can be automated and executed by a computer, computer system, user agent, and/or electronic device. The term "automated" means controlled operation of an apparatus, system, and/or process using computers and/or mechanical/electrical devices without the necessity of human intervention, observation, effort, and/or decision.

The methods in accordance with example embodiments are provided as examples, and examples from one method should not be construed to limit examples from another method. Further, methods discussed within different figures can be added to or exchanged with methods in other figures. Further yet, specific numerical data values (such as specific quantities, numbers, categories, etc.) or other specific information should be interpreted as illustrative for discussing example embodiments. Such specific information is not provided to limit example embodiments.

What is claimed is:

1. A method comprising:

displaying, on a display of an electronic scope mounted to a rifle with a first user, a point of aim (POA) that shows where the rifle with the first user is aimed;

displaying, on a display of first wearable electronic glasses (WEG) worn on a head of the first user with the rifle and in wireless communication with the electronic scope, the POA that shows where the rifle with the first user is aimed and that moves in real-time with movements of the rifle with the first user; and displaying, on a display of second WEG worn on a head of a second user and in wireless communication with the first WEG, the POA that shows where the rifle with the first user is aimed and that moves in real-time with movements of the rifle with the first user.

2. The method of claim 1 further comprising:

tracking, with one or more sensors in the first WEG, an orientation of the rifle with the first user; and deactivating displaying of the POA displayed on the display of the first WEG when the first WEG senses the orientation of the rifle with the first user is directed to ground.

3. The method of claim 1 further comprising:

tracking, with one or more sensors in the first WEG, an orientation of the rifle with the first user; and activating displaying of the POA displayed on the display of the first WEG when the first WEG senses the orientation of the rifle with the first user is directed away from ground.

4. The method of claim 1 further comprising:

tracking, with one or more sensors in the first WEG, an orientation of the rifle with the first user; and activating displaying of the POA displayed on the display of the first WEG when the first WEG determines the orientation of the rifle with the first user is directed to a target.

5. The method of claim 1 further comprising:

displaying a target on the display of the electronic scope and on the display of the first WEG;

receiving, at a natural language user interface of the first WEG, a voice command to track the target; and tracking, with one or more sensors in the electronic scope, the target in response to receiving the voice command.

6. The method of claim 1 further comprising:

moving, with a handheld portable electronic device (HPED) that is with the first user and that is in wireless communication with at least one of the electronic scope and the first WEG, a location of the POA displayed on the display of the electronic scope and the display of the first WEG.

7. The method of claim 1 further comprising:

instructing, with a handheld portable electronic device (HPED) that is with the first user and that is in wireless communication with at least one of the electronic scope and the first WEG, the rifle with the first user to fire.

8. The method of claim 1 further comprising:

executing, with a processor, code stored in memory that compares the POA on a target when a bullet is fired from the rifle with an image or video of an impact location on the target where the bullet hit the target and moves the POA to compensate for a difference between the POA on the target and the impact location of the bullet on the target.

9. A non-transitory computer readable storage medium storing instructions that cause one or more processors to execute a method, comprising:

wirelessly receiving, from an electronic scope mounted to a rifle with a first user and to a first wearable electronic device (WED) worn on a head of the first user, data captured with a camera of the electronic scope that displays a point of aim (POA) of the rifle;

displaying, on a display of the first WED worn on the head of the first user, the POA that shows where the rifle with the first user is aimed and that moves in real-time with movements of the rifle; and displaying, on a display of a second WED worn on a head of a second user and in wireless communication with the first WED, the POA that shows where the rifle with the first user is aimed and that moves in real-time with movements of the rifle.

10. The non-transitory computer readable storage medium storing instructions of claim 9 in which the method further comprises:

receiving, at the first WED and from the first user, a voice command to stop displaying the POA on the first WED.

11. The non-transitory computer readable storage medium storing instructions of claim 9 in which the method further comprises:

receiving, at the first WED and from the electronic scope, a distance from the rifle to a target at which the rifle is aimed; and moving, by the first WED, a location of where the POA appears on the display of the first WED to compensate for bullet drop due to changes to the distance from the rifle to the target.

12. The non-transitory computer readable storage medium storing instructions of claim 9 in which the method further comprises:

determining, by the first WED, a shooting condition that caused a bullet fired from the rifle to miss a target; and automatically moving, by the first WED and in response to the determining that the bullet missed the target, a location where the POA is displayed to compensate for the shooting condition and to sight the rifle to the target.

13. The non-transitory computer readable storage medium storing instructions of claim 9 in which the method further comprises:

determining, by the first WED, that the POA displayed on the display of the first WED does not coincide with where the rifle is aimed; and automatically moving, by the first WED, a location where the POA is displayed on the display of the first WED so the POA displayed on the first WED coincides with where the rifle is aimed such that a bullet fired from the rifle hits a target at the POA displayed on the display of the first WED.

14. The non-transitory computer readable storage medium storing instructions of claim 9 in which the method further comprises:

automatically firing the rifle when the POA displayed on the display of the first WED aligns with a target seen through the display of the first WED.

15. The non-transitory computer readable storage medium storing instructions of claim 9 in which the method further comprises:

automatically moving, by the first WED, a location where the POA is displayed on the display of the first WED to compensate for at least one of jitter and bore temperature of the rifle.

16. The non-transitory computer readable storage medium storing instructions of claim 9 in which the method further comprises:

automatically moving, by the first WED, a location where the POA is displayed on the display of the first WED to compensate for real-time movements of a target that cause distances from the rifle and the target to change.

17. A weapon targeting system, comprising:

a first wearable electronic device (WED) that is worn on a head of a first user with a rifle, wirelessly communicates with an electronic scope mounted to the rifle, includes a display that displays a point of aim (POA) where the rifle is aimed, and moves the POA to coincide with real-time movements of the rifle; and a second wearable electronic device (WED) that is worn on a head of a second user, wirelessly communicates with the first WED, includes a display that displays the POA where the rifle of the first user is aimed, and moves the POA to coincide with real-time movements of the rifle of the first user.

18. The weapon targeting system of claim 17 further comprising:

a handheld portable electronic device (HPED) with the first user that wirelessly communicates with the first WED, and activates and deactivates displaying of the POA on the display of the first WED.

19. The weapon targeting system of claim 17 further comprising:

a handheld portable electronic device (HPED) with the first user that includes a processor that executes code stored in memory to automatically move a location where the POA displays on the display of the first WED to compensate for bullet drop when a distance from the rifle to a target changes.

20. The weapon targeting system of claim 17 further comprising:

a handheld portable electronic device (HPED) with the first user that includes a processor that executes code stored in memory to automatically move a location where the POA displays on the display of the first WED so the rifle is zeroed for environmental shooting conditions where the rifle is located.

* * * * *